US011100835B2

(12) United States Patent
Wang et al.

(10) Patent No.: US 11,100,835 B2
(45) Date of Patent: Aug. 24, 2021

(54) SHIFT REGISTER UNIT, METHOD OF DRIVING SHIFT REGISTER UNIT, GATE DRIVING CIRCUIT, AND DISPLAY DEVICE

(71) Applicants: HEFEI BOE DISPLAY TECHNOLOGY CO., LTD., Anhui (CN); BOE TECHNOLOGY GROUP CO., LTD., Beijing (CN)

(72) Inventors: Xipeng Wang, Beijing (CN); Wei Zhang, Beijing (CN); Chao Xu, Beijing (CN); Yunfei Liu, Beijing (CN); Jincheng Jia, Beijing (CN); Benzhi Xu, Beijing (CN); Bin Li, Beijing (CN); Qi Liu, Beijing (CN); Ji Zhang, Beijing (CN)

(73) Assignees: HEFEI BOE DISPLAY TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/961,581

(22) PCT Filed: Jan. 21, 2020

(86) PCT No.: PCT/CN2020/073557

§ 371 (c)(1),
(2) Date: Jul. 10, 2020

(87) PCT Pub. No.: WO2020/156383

PCT Pub. Date: Aug. 6, 2020

(65) Prior Publication Data

US 2021/0193006 A1 Jun. 24, 2021

(30) Foreign Application Priority Data

Jan. 29, 2019 (CN) ..... 201910086129.1

(51) Int. Cl.
*G09G 3/20* (2006.01)
*G09G 3/36* (2006.01)

(52) U.S. Cl.
CPC ..... *G09G 3/20* (2013.01); *G09G 3/36* (2013.01); *G09G 3/3677* (2013.01); *G09G 2310/0286* (2013.01); *G09G 2310/08* (2013.01)

(58) Field of Classification Search
None
See application file for complete search history.

(56) References Cited

U.S. PATENT DOCUMENTS 4,577,189 A * 3/1986 Adolfsson ..... G11C 11/42 250/214 LS
2007/0229433 A1* 10/2007 Jang ..... G09G 3/3696 345/96

(Continued)

FOREIGN PATENT DOCUMENTS

CN 104756405 A 7/2015
CN 105632563 A 6/2016

(Continued)

*Primary Examiner* — Dorothy Harris

(57) ABSTRACT

A shift register unit, a method of driving a shift register unit, a gate driving circuit, and a display device are disclosed. The shift register unit includes an input circuit and an output circuit. The input circuit is configured to write an input signal of the input terminal to the first node in response to an input control signal, so as to control a level of the first node. The output circuit is configured to receive a clock signal of the clock signal terminal and output a scanning signal through the pixel signal output terminal under control of the level of the first node. The output circuit includes a variable resistor, and the variable resistor is configured to adjust a level of the scanning signal according to a resistance value of the variable resistor.

20 Claims, 10 Drawing Sheets

(56) References Cited

U.S. PATENT DOCUMENTS

| | | | | |
|---|---|---|---|---|
| 2013/0321036 | A1* | 12/2013 | Huang | H03K 19/017509 327/109 |
| 2015/0161959 | A1* | 6/2015 | Hsu | G09G 3/3677 345/204 |
| 2015/0295565 | A1 | 10/2015 | Maeda et al. | |
| 2016/0189654 | A1* | 6/2016 | Kim | G09G 3/3696 345/690 |
| 2019/0311689 | A1* | 10/2019 | Takahashi | G09G 3/36 |

FOREIGN PATENT DOCUMENTS

| | | | | |
|---|---|---|---|---|
| CN | 108766381 | A | | 11/2018 |
| CN | 109559674 | A | | 4/2019 |
| JP | 08184803 | A | * | 7/1996 |
| KR | 20130121389 | A | | 11/2013 |

* cited by examiner

SHIFT REGISTER UNIT, METHOD OF DRIVING SHIFT REGISTER UNIT, GATE DRIVING CIRCUIT, AND DISPLAY DEVICE

The present application claims the priority of Chinese patent application No. 201910086129.1, filed on Jan. 29, 2019, the entire disclosure of which is incorporated herein by reference as part of the disclosure of this application.

TECHNICAL FIELD

Embodiments of the present disclosure relate to a shift register unit, a method of driving a shift register unit, a gate driving circuit, and a display device.

BACKGROUND

In the field of display technologies, for example, the pixel array of a liquid crystal display panel generally includes rows of gate lines and columns of data lines that intersect with each other. Driving of the gate lines can be implemented by a gate driving circuit. For example, the gate driving circuit can be implemented by a bonded integrated driving circuit. In recent years, with the continuous improvement of the manufacturing process of amorphous silicon thin film transistors or oxide thin film transistors, the gate driving circuit can also be directly fabricated on a thin film transistor array substrate to form a gate driver on array (GOA) to drive the gate lines. For example, the GOA formed of a plurality of cascaded shift register units can be used to provide switching voltage signals for the rows of gate lines of the pixel array, thereby controlling the rows of gate lines to be turned on sequentially, and at the same time, data signals are provided by the data lines to the pixel units of a corresponding row in the pixel array, so as to form the gray voltages required for each gray level of the display image in each pixel unit, thereby displaying a frame of image. Current display panels increasingly use the GOA technology to drive the gate lines. The GOA technology helps to achieve a narrow bezel and can reduce the production cost.

SUMMARY

At least one embodiment of the present disclosure provides a shift register unit, which comprises an input circuit and an output circuit. The input circuit is connected to an input terminal and a first node, and is configured to write an input signal of the input terminal to the first node in response to an input control signal to control a level of the first node. The output circuit is connected to the first node, a clock signal terminal, and a pixel signal output terminal, and is configured to receive a clock signal of the clock signal terminal and output a scanning signal through the pixel signal output terminal under control of the level of the first node. The output circuit comprises a variable resistor, and the variable resistor is configured to adjust a level of the scanning signal according to a resistance value of the variable resistor.

For example, in the shift register unit provided by an embodiment of the present disclosure, the variable resistor comprises a photoresistor, the photoresistor comprises a photoelectric sensitive material, and a resistance value of the photoelectric sensitive material is in a negative correlation with light intensity that is received.

For example, in the shift register unit provided by an embodiment of the present disclosure, the variable resistor comprises a thermistor having a negative temperature coefficient.

For example, in the shift register unit provided by an embodiment of the present disclosure, the output circuit is further connected to a shift signal output terminal, and the output circuit further comprises a first transistor, a second transistor, and a first capacitor; a gate electrode of the first transistor is connected to the first node, a first electrode of the first transistor is connected to the clock signal terminal, and a second electrode of the first transistor is connected to the shift signal output terminal; a gate electrode of the second transistor is connected to the first node, a first electrode of the second transistor is connected to the clock signal terminal, and a second electrode of the second transistor is connected to a first terminal of the variable resistor; a first electrode of the first capacitor is connected to the first node, and a second electrode of the first capacitor is connected to the pixel signal output terminal; and a second terminal of the variable resistor is connected to the pixel signal output terminal.

For example, in the shift register unit provided by an embodiment of the present disclosure, the input circuit comprises a third transistor; and a gate electrode of the third transistor is connected to a first electrode of the third transistor, and is connected to the input terminal, the gate electrode of the third transistor receives the input signal as the input control signal, and a second electrode of the third transistor is connected to the first node.

For example, the shift register unit provided by an embodiment of the present disclosure further comprises a first control circuit, a second control circuit, a first node noise reduction circuit, an output noise reduction circuit, a first reset circuit, and a second reset circuit. The first control circuit is configured to control a level of a second node under control of the level of the first node and a level of a first control node; the second control circuit is configured to control the level of the first control node under control of the level of the first node; the first node noise reduction circuit is configured to perform noise reduction on the first node under control of the level of the second node; the output noise reduction circuit is configured to perform noise reduction on the shift signal output terminal and the pixel signal output terminal under control of the level of the second node; the first reset circuit is configured to reset the first node in response to a first reset signal; and the second reset circuit is configured to reset the first node in response to a second reset signal.

For example, in the shift register unit provided by an embodiment of the present disclosure, the first control circuit comprises a fourth transistor and a fifth transistor; a gate electrode of the fourth transistor is connected to the first control node, a first electrode of the fourth transistor is connected to a first voltage terminal, and a second electrode of the fourth transistor is connected to the second node; and a gate electrode of the fifth transistor is connected to the first node, a first electrode of the fifth transistor is connected to the second node, and a second electrode of the fifth transistor is connected to a second voltage terminal.

For example, in the shift register unit provided by an embodiment of the present disclosure, the second control circuit comprises a sixth transistor and a seventh transistor, a gate electrode of the sixth transistor is connected to a first electrode of the sixth transistor, and is connected to a first voltage terminal, and a second electrode of the sixth transistor is connected to the first control node; and a gate electrode of the seventh transistor is connected to the first node, a first electrode of the seventh transistor is connected to the first control node, and a second electrode of the seventh transistor is connected to a second voltage terminal.

For example, in the shift register unit provided by an embodiment of the present disclosure, the first node noise reduction circuit comprises an eighth transistor, and a gate electrode of the eighth transistor is connected to the second node, a first electrode of the eighth transistor is connected to the first node, and a second electrode of the eighth transistor is connected to a second voltage terminal.

For example, in the shift register unit provided by an embodiment of the present disclosure, the output noise reduction circuit comprises a ninth transistor and a tenth transistor, a gate electrode of the ninth transistor is connected to the second node, a first electrode of the ninth transistor is connected to the shift signal output terminal, and a second electrode of the ninth transistor is connected to a second voltage terminal; and a gate electrode of the tenth transistor is connected to the second node, a first electrode of the tenth transistor is connected to the pixel signal output terminal, and a second electrode of the tenth transistor is connected to a third voltage terminal.

For example, in the shift register unit provided by an embodiment of the present disclosure, the first reset circuit comprises an eleventh transistor, a gate electrode of the eleventh transistor is connected to a first reset terminal, a first electrode of the eleventh transistor is connected to the first node, and a second electrode of the eleventh transistor is connected to a second voltage terminal; and the second reset circuit comprises a twelfth transistor, a gate electrode of the twelfth transistor is connected to a second reset terminal, a first electrode of the twelfth transistor is connected to the first node, and a second electrode of the twelfth transistor is connected to the second voltage terminal.

At least one embodiment of the present disclosure further provides a gate driving circuit, which comprises the shift register unit according to any one of the embodiments of the present disclosure.

At least one embodiment of the present disclosure further provides a display device, which comprises the gate driving circuit according to any one of the embodiments of the present disclosure, and further comprises a backlight and an array substrate. The array substrate comprises a base substrate, a light blocking layer, and a gate driving circuit layer, the light blocking layer is on the base substrate, the gate driving circuit layer is on a side, away from the base substrate, of the light blocking layer, and the gate driving circuit is provided in the gate driving circuit layer; and the gate driving circuit layer comprises the variable resistor, and the light blocking layer has an opening at a position corresponding to the variable resistor, so that light emitted by the backlight can be irradiated to the variable resistor through the opening.

For example, in the display device provided by an embodiment of the present disclosure, the gate driving circuit comprises a plurality of shift register units that are cascaded, and the backlight comprises a plurality of light-emitting regions; and the plurality of shift register units are in one-to-one correspondence with the plurality of light-emitting regions, and a projection of the variable resistor, which is in respective shift register unit, in a direction perpendicular to the base substrate is within a corresponding light-emitting region.

At least one embodiment of the present disclosure further provides a method of driving the shift register unit according to any one of the embodiments of the present disclosure, and the method comprises: in an input phase, by the input circuit, writing the input signal to the first node in response to the input control signal and controlling the level of the first node to a first level, and by the output circuit, outputting the scanning signal with a second level through the pixel signal output terminal; and in an output phase, by the output circuit, outputting the scanning signal with a third level through the pixel signal output terminal. The third level varies according to the resistance value of the variable resistor. In the output phase, in the case where light intensity received by the variable resistor increases, the resistance value of the variable resistor decreases to adjust the third level, so as to allow the third level to increase; and in the case where the light intensity decreases, the resistance value of the variable resistor increases to adjust the third level, so as to allow the third level to decrease.

BRIEF DESCRIPTION OF THE DRAWINGS

In order to clearly illustrate the technical solution of the embodiments of the present disclosure, the drawings of the embodiments will be briefly described in the following. It is obvious that the described drawings in the following are only related to some embodiments of the present disclosure and thus are not limitative of the present disclosure.

DETAILED DESCRIPTION

Figure 1:
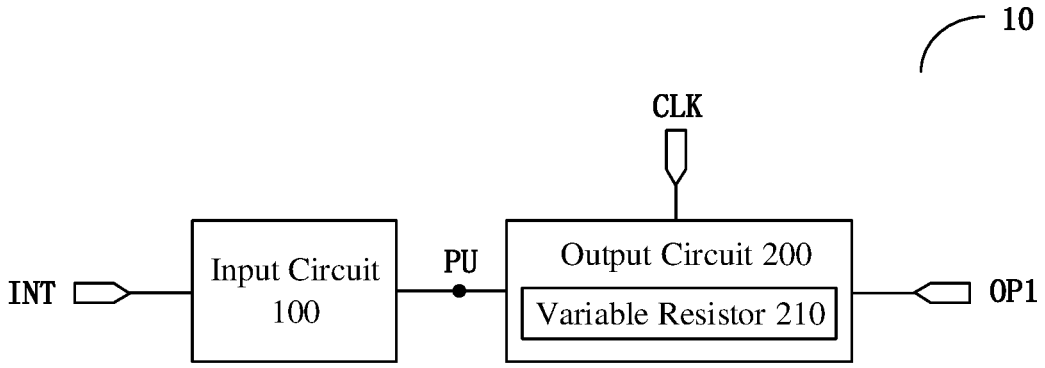
FIG. 1 is a schematic block diagram of a shift register unit provided by some embodiments of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", "coupled", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

For the high-generation production line of the thin film transistor-liquid crystal display (TFT-LCD), because the price of the mask is high, the production cost of the TFT-LCD panel is high. In order to reduce the production cost of products as much as possible, manufacturers generally use a process with fewer masks to manufacture the TFT-LCD panel, such as a 4 mask process. In the 4 mask process, an active layer of a TFT and a data line metal layer are patterned by using the same mask in the same photomask process. In this way, the active layer is under the data line, and the data line is in direct contact with the active layer. In the case where the active layer is exposed to light, carrier migration occurs in the active layer, which causes the active layer to become a conductive layer, and causes the capacitance (such as the parasitic capacitance, the coupling capacitance, capacitive devices connected to the data line, etc.) of the data line to change compared to the capacitance in a dark state, thereby causing that the RC Delay generated when the data signal is written into the pixel unit through the data line may have a significant difference between the bright state of the illumination and the dark state of the illumination.

In the case where the backlight of the TFT-LCD panel adopts, for example, a local dimming mode (a dimming mode using a time-domain duty cycle) to adjust the light intensity, because the brightness of different regions of the backlight are not uniform when the entire backlight does not reach the highest brightness, illumination conditions of the different regions of the TFT-LCD panel are different, resulting in different RC Delay in different regions of the panel when writing data signals, which further causes charging rates (that is, the ratio of the voltage of the pixel electrode and the voltage of the data signal after charging) of the pixel units (liquid crystal capacitors) in different regions to be different, and then horizontal stripes (block) or other display defects are generated in the display image.

At least one embodiment of the present disclosure provides a shift register unit, a method of driving a shift register unit, a gate driving circuit, and a display device. The shift register unit can change the level of the scanning signal, that is outputted, according to the light intensity of the backlight, so as to allow the level in the bright state to be higher than the level in the dark state, thereby adjusting the charging rate of the corresponding pixel unit receiving the scanning signal in the display panel, so that the charging effects of the pixel unit are the same or similar when the light intensity is different, which reduces or eliminates the horizontal stripes caused by the RC delay due to different light intensity.

Hereinafter, the embodiments of the present disclosure are described in detail with reference to the accompanying drawings. It should be noted that same or similar reference numbers in different drawings are used for indicating same elements that have been described.

At least one embodiment of the present disclosure provides a shift register unit, a plurality of the shift register units can be cascaded to form a gate driving circuit to sequentially output a plurality of scanning signals, and the shift register unit includes an input circuit and an output circuit. The input circuit is connected to an input terminal and a first node, and is configured to write an input signal of the input terminal to the first node in response to an input control signal to control a level of the first node. The output circuit is connected to the first node, a clock signal terminal, and a pixel signal output terminal, and is configured to receive a clock signal of the clock signal terminal and output a scanning signal through the pixel signal output terminal under control of the level of the first node. The output circuit includes a variable resistor, and the variable resistor is configured to adjust a level of the scanning signal according to a resistance value of the variable resistor.

FIG. 1 is a schematic block diagram of a shift register unit provided by some embodiments of the present disclosure. As illustrated in FIG. 1, a shift register unit 10 includes an input circuit 100 and an output circuit 200.

The input circuit 100 is connected to an input terminal INT and a first node PU, and is configured to write an input signal of the input terminal INT to the first node PU in response to an input control signal to control the level of the first node PU. For example, in some examples, the input signal of the input terminal INT may be used as the input control signal. For example, in the case of using the input signal as the input control signal, the input circuit 100 electrically connects the first node PU and the input terminal TNT under the control of the input signal, so that a high level of the input signal can charge the first node PU to increase the level of the first node PU, so as to control the output circuit 200 to be turned on. Of course, the embodiments of the present disclosure are not limited to this case, and for example, the input circuit 100 may also be connected to a high voltage terminal provided separately, and is configured to electrically connect the first node PU and the high voltage terminal under the control of the input signal provided by the input terminal TNT, so that a high-level signal output from the high voltage terminal can charge the first node PU. In some other embodiments, a low level of the input signal may also be used to discharge the first node PU, so that the level of the first node PU is reduced to control the output circuit 200 to be turned on, and the method of changing the level of the first node PU (that is, increasing or decreasing) can be determined according to the specific implementation of the output circuit 200.

The output circuit 200 is connected to the first node PU, a clock signal terminal CLK and a pixel signal output terminal OP1, and is configured to receive a clock signal of the clock signal terminal CLK and output a scanning signal through the pixel signal output terminal OP1 under control of the level of the first node PU. For example, the output circuit 200 is turned on under the control of the level of the first node PU to electrically connect the clock signal terminal CLK and a first terminal of a variable resistor 210, and a second terminal of the variable resistor 210 is electrically connected to the pixel signal output terminal OP1, so that the output circuit 200 can output the scanning signal through the pixel signal output terminal OP1 after receiving the clock signal. The scanning signal, as an output signal of the shift register unit 10, is used to drive, for example, a gate line of a display panel connected to the pixel signal output terminal OP1.

The output circuit 200 includes the variable resistor 210, and the variable resistor 210 is configured to adjust the level of the scanning signal according to the resistance value of the variable resistor 210. For example, the resistance value of the variable resistor 210 may change according to changes in environmental conditions. For example, in some examples, the variable resistor 210 is a photoresistor, the photoresistor includes a photoelectric sensitive material, and the resistance value of the photoelectric sensitive material (that is, the resistance value of the photoresistor) is in a negative correlation with light intensity that is received. When the light intensity changes, the resistance value of the photoresistor changes. Because the photoresistor is connected between the clock signal terminal CLK and the pixel signal output terminal OP1, the level of the scanning signal output from the pixel signal output terminal OP1 may change, so as to achieve the purpose of adjusting the level of the scanning signal according to the resistance value of the photoresistor. The photoresistor is manufactured by a semiconductor material, that is, the photoelectric sensitive material described above is a semiconductor material, such as selenium, cadmium sulfide, cadmium selenide, cadmium telluride, gallium arsenide, silicon, germanium, zinc sulfide, etc. The embodiments of the present disclosure are not limited in the material and form of the photoresistor.

For example, in the case where the light intensity increases, the resistance value of the photoresistor decreases to adjust the level of the scanning signal, so that the level of the scanning signal increases; and in the case where the light intensity decreases, the resistance value of the photoresistor increases to adjust the level of the scanning signal, so that the level of the scanning signal decreases. That is, the photoresistor can enable the level of the scanning signal in a bright state of illumination to be higher than the level of the scanning signal in a dark state. In the case where a plurality of the above shift register units 10 are cascaded to form a gate driving circuit, changes in the level (changes in voltage) of the scanning signal can adjust the charging rate of pixel units of the display panel adopting the gate driving circuit, so that the charging effects of the pixel units are the same or similar under the conditions of different light intensity (different RC Delay), which can reduce or eliminate horizontal stripes caused by RC Delay due to different light intensity, and alleviate or avoid the influence of the RC Delay caused by different light intensity on display effect.

It should be noted that, in some embodiments of the present disclosure, the shift register unit 10 may be applied to a display panel with a backlight, and the backlight adopts, for example, a local dimming mode to adjust the light intensity. Of course, the embodiments of the present disclosure are not limited to this case, and the shift register unit 10 may also be applied to a display panel having a backlight that adopts other operation modes (for example, adjusting brightness by using current).

It should be noted that, in some embodiments of the present disclosure, the variable resistor 210 is not limited to the photoresistor, and may also adopt resistors with other sensitive characteristics, such as a thermistor, etc. Accordingly, changes in environmental conditions may refer to changes in temperature, etc. In the case where the variable resistor 210 is a thermistor, the backlight that adopts the local dimming mode to adjust the light intensity may release heat during operation, and the region with a greater light intensity has a higher temperature, so the resistance value of the thermistor may change accordingly, thereby achieving the purpose of adjusting the level of the scanning signal according to the resistance value of the thermistor. For example, the thermistor has a negative temperature coefficient, so that the resistance value of the thermistor is in a negative correlation with the temperature, so as to achieve a similar effect as the aforementioned photoresistor. The material of the thermistor is, for example, metal oxides including manganese, cobalt, nickel, or copper, which has a negative temperature coefficient. The embodiments of the present disclosure do not limit the material and form of the thermistor.

Figure 2:
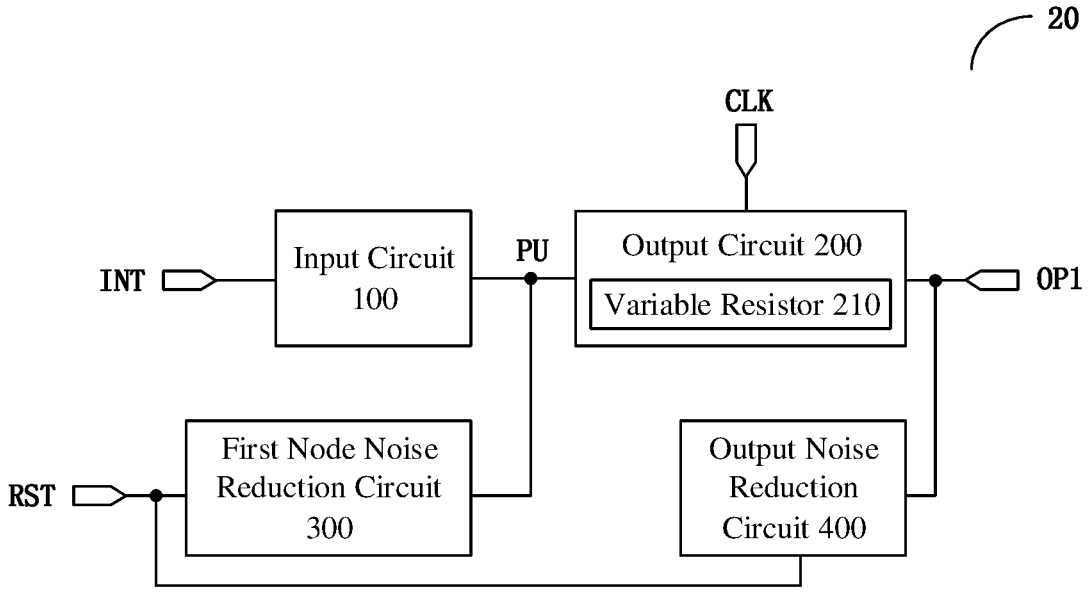
FIG. 2 is a schematic block diagram of another shift register unit provided by some embodiments of the present disclosure.

FIG. 2 is a schematic block diagram of another shift register unit provided by some embodiments of the present disclosure. As illustrated in FIG. 2, a shift register unit 20 in this embodiment further includes a first node noise reduction circuit 300 and an output noise reduction circuit 400, and other structures are basically the same as the shift register unit 10 illustrated in FIG. 1.

The first node noise reduction circuit 300 is configured to perform noise reduction on the first node PU under the control of a noise reduction control signal of a noise reduction control signal terminal RST. For example, the first node noise reduction circuit 300 is connected to the first node PU, the noise reduction control signal terminal RST, and a voltage terminal that is provided separately (for example, a low voltage terminal), and is configured to enable the first node PU to be electrically connected to the voltage terminal that is provided separately, under the control of the noise reduction control signal, so as to perform noise reduction on the first node PU (e.g., pull down the first node PU).

The output noise reduction circuit 400 is configured to perform noise reduction on the pixel signal output terminal OP1 under the control of the noise reduction control signal of the noise reduction control signal terminal RST. For example, the output noise reduction circuit 400 is connected to the pixel signal output terminal OP1, the noise reduction control signal terminal RST, and a voltage terminal that is provided separately (for example, a low voltage terminal), and is configured to enable the pixel signal output terminal OP1 to be electrically connected to the voltage terminal that is provided separately, under the control of the noise reduction control signal, so as to perform noise reduction on the pixel signal output terminal OP1 (e.g., pull down the pixel signal output terminal OP1). For example, in some other embodiments, the output noise reduction circuit 400 may also be connected to other control signal terminals without being connected to the noise reduction control signal terminal RST, so that the output noise reduction circuit 400 can receive other control signals different from the noise reduction control signal, and thus the output noise reduction circuit 400 and the first node noise reduction circuit 300 can be controlled independently.

Figure 3:
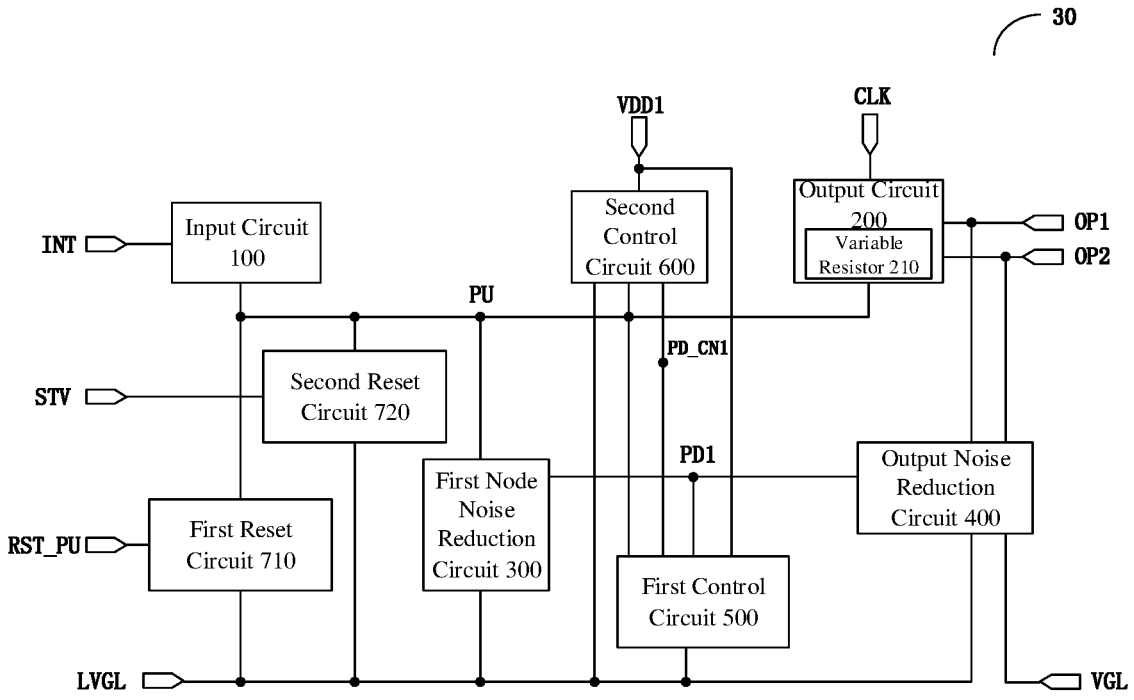
FIG. 3 is a schematic block diagram of another shift register unit provided by some embodiments of the present disclosure.

FIG. 3 is a schematic block diagram of another shift register unit provided by some embodiments of the present disclosure. As illustrated in FIG. 3, a shift register unit 30 in this embodiment further includes a first control circuit 500, a second control circuit 600, a first node noise reduction circuit 300, an output noise reduction circuit 400, a first reset circuit 710, and a second reset circuit 720, and other structures are basically the same as the shift register unit 10 illustrated in FIG. 1. It should be noted that, in this embodiment, the output circuit 200 is not only connected to the pixel signal output terminal OP1, but also connected to a shift signal output terminal OP2, so as to improve the driving capability of the shift register unit 30. The pixel signal output terminal OP1 is used to provide a scanning signal for a pixel circuit, and the shift signal output terminal OP2 is used to provide an input signal to other cascaded shift register units.

The first control circuit 500 is configured to control a level of a second node PD1 under the control of the level of the first node PU and a level of a first control node PD_CN1. For example, the first control circuit 500 is connected to a first voltage terminal VDD1, a second voltage terminal LVGL, the first node PU, the second node PD1, and the first control node PD_CN1, and is configured to enable the second node PD1 to be electrically connected to the second voltage terminal LVGL under the control of the level of the first node PU, so that the level of the second node PD1 is controlled (for example, pulled down) to be at a low level. In addition, the first control circuit 500 can enable the second node PD1 to be electrically connect to the first voltage terminal VDD1 under the control of the level of the first control node PD_CN1, so that the second node PD1 is charged to be at a high level when the first voltage terminal VDD1 provides a high-level signal.

The second control circuit 600 is configured to control the level of the first control node PD_CN1 under the control of the level of the first node PU. For example, the second control circuit 600 is connected to the first voltage terminal VDD1, the second voltage terminal LVGL, the first node PU, and the first control node PD_CN1, and is configured to enable the first control node PD_CN1 to be electrically connected to the second voltage terminal LVGL under the control of the level of the first node PU, so that the level of the first control node PD_CN1 is pulled down to be at a low level. In addition, the second control circuit 600 can enable the first control node PD_CN1 to be at a high level when the first voltage terminal VDD1 provides a high-level signal.

The first node noise reduction circuit 300 is configured to perform noise reduction on the first node PU under the control of the level of the second node PD1. For example, the first node noise reduction circuit 300 is connected to the second voltage terminal LVGL, the first node PU, and the second node PD1, and is configured to enable the first node PU to be electrically connected to the second voltage terminal LVGL, under the control of the level of the second node PD1, so as to perform noise reduction on the first node PU (e.g., pull down the first node PU).

The output noise reduction circuit 400 is configured to perform noise reduction on the pixel signal output terminal OP1 and the shift signal output terminal OP2 under the control of the level of the second node PD1. For example, the output noise reduction circuit 400 is connected to the second voltage terminal LVGL, a third voltage terminal VGL, the pixel signal output terminal OP1, the shift signal output terminal OP2, and the second node PD1, and is configured to, under the control of the level of the second node PD1, enable the pixel signal output terminal OP1 to be electrically connected to the third voltage terminal VGL, and enable the shift signal output terminal OP2 to be electrically connected to the second voltage terminal LVGL, thereby respectively performing noise reduction on the pixel signal output terminal OP1 and the shift signal output terminal OP2 (e.g., pulling down the pixel signal output terminal OP1 and the shift signal output terminal OP2). For example, the second voltage terminal LVGL and the third voltage terminal VGL may be the same voltage terminal or different voltage terminals, which is not limited in the embodiments of the present disclosure.

The first reset circuit 710 is configured to reset the first node PU in response to a first reset signal. For example, the first reset circuit 710 is connected to the first node PU, a first reset terminal RST_PU, and the second voltage terminal LVGL, and is configured to, under the control of the first reset signal provided by the first reset terminal RST_PU, enable the first node PU to be electrically connected to the second voltage terminal LVGL, so as to reset the first node PU. For example, the first reset circuit 710 is configured to reset the first node PU after the output of the shift register unit 30 ends, that is, reset the shift register unit of the current stage.

The second reset circuit 720 is configured to reset the first node PU in response to a second reset signal. For example, the second reset circuit 720 is connected to the first node PU, a second reset terminal STV, and the second voltage terminal LVGL, and is configured to, under the control of the second reset signal provided by the second reset terminal STV, enable the first node PU to be electrically connected to the second voltage terminal LVGL, so as to reset the first node PU. For example, the second reset circuit 720 may reset the first node PU before the scanning of one frame of image and after the scanning of one frame of image, respectively, or may reset the first node PU only before the scanning of one frame of image or only after the scanning of one frame of image, that is, perform a total reset (in this case, all shift register units that are cascade are reset).

It should be noted that in this embodiment, the variable resistor 210 can adjust the level of the scanning signal output from the pixel signal output terminal OP1, but cannot adjust the level of the shift signal output from the shift signal output terminal OP2, so the variable resistor 210 does not affect the shift signal, thereby avoiding affecting the normal function of the gate driving circuit that is formed by a plurality of cascaded shift register units.

In this embodiment, for example, the first voltage terminal VDD1 is configured to keep inputting a DC high-level signal, and the DC high level is referred to as a first voltage. In some other embodiments, in order to match the circuit structure, the first voltage terminal VDD1 may also be configured to alternately input a DC high-level signal and a DC low-level signal, and the first voltage may be determined according to a specific circuit structure. For example, the second voltage terminal LVGL is configured to keep inputting a DC low-level signal, and the DC low level is referred to as a second voltage. The third voltage terminal VGL is configured to keep inputting a DC low-level signal, and the DC low level is referred to as a third voltage. For example, the second voltage and the third voltage may be the same or different. Regarding the voltages and the voltage terminals, the following embodiments are the same, and similar description may not be repeated herein.

Figure 4:
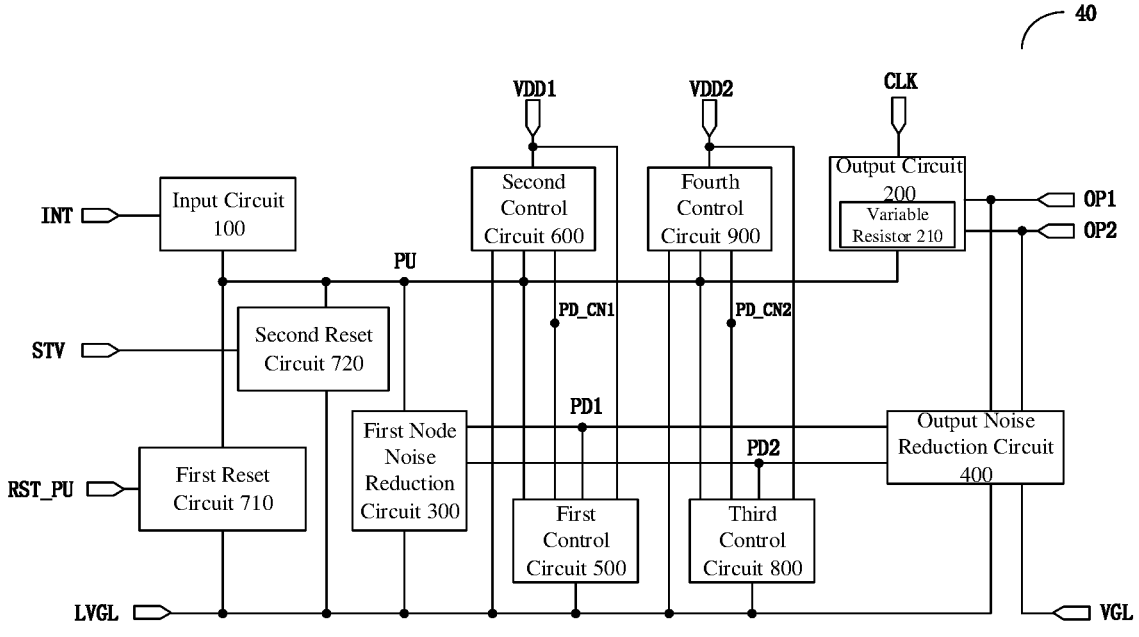
FIG. 4 is a schematic block diagram of another shift register unit provided by some embodiments of the present disclosure.

FIG. 4 is a schematic block diagram of another shift register unit provided by some embodiments of the present disclosure. As illustrated in FIG. 4, compared to the shift register unit 30 illustrated in FIG. 3, a shift register unit 40 in this embodiment further includes a third control circuit 800 and a fourth control circuit 900, and accordingly, further includes a third node PD2 and a second control node PD_CN2. Other structures of the shift register unit 40 are basically the same as the shift register unit 30 illustrated in FIG. 3, and are not repeated here.

The third control circuit 800 is configured to control a level of the third node PD2 under the control of the level of the first node PU and a level of the second control node PD_CN2. For example, the third control circuit 800 is connected to a fourth voltage terminal VDD2, the second voltage terminal LVGL, the first node PU, the third node PD2, and the second control node PD_CN2, and is configured to enable the third node PD2 to be electrically connected to the second voltage terminal LVGL under the control of the level of the first node PU, so that the level of the third node PD2 is controlled (for example, pulled down) to be at a low level. In addition, the third control circuit 800 can enable the third node PD2 to be electrically connected to the fourth voltage terminal VDD2 under the control of the level of the second control node PD_CN2, so that the third node PD2 is charged to be at a high level when the fourth voltage terminal VDD2 provides a high-level signal.

The fourth control circuit 900 is configured to control the level of the second control node PD_CN2 under the control of the level of the first node PU. For example, the fourth control circuit 900 is connected to the fourth voltage terminal VDD2, the second voltage terminal LVGL, the first node PU, and the second control node PD_CN2, and is configured to enable the second control node PD_CN2 to be electrically connected to the second voltage terminal LVGL under the control of the level of the first node PU, so that the level of the second control node PD_CN2 is pulled down to be at a low level. In addition, the fourth control circuit 900 can enable the second control node PD_CN2 to be at a high level when the fourth voltage terminal VDD2 provides a high-level signal.

Correspondingly, the first node noise reduction circuit 300 is connected to both the second node PD1 and the third node PD2, and is configured to perform noise reduction on the first node PU under the control of the level of the second node PD1 or the level of the third node PD2. The output noise reduction circuit 400 is connected to both the second node PD1 and the third node PD2, and is configured to perform noise reduction on the pixel signal output terminal OP1 and the shift signal output terminal OP2 under the control of the level of the second node PD1 or the level of the third node PD2.

In this embodiment, the first voltage terminal VDD1 and the fourth voltage terminal VDD2 are configured to alternately provide a DC high-level signal, and the second node PD1 and the third node PD2 are alternately at a high level by the action of the first control circuit 500, the second control circuit 600, the third control circuit 800, and the fourth control circuit 900, thereby controlling the first node noise reduction circuit 300 and the output noise reduction circuit 400 to respectively perform noise reduction on the first node PU and the pixel signal output terminal OP1 as well as the shift signal output terminal OP2. For example, when the first voltage terminal VDD1 provides a high-level signal, the fourth voltage terminal VDD2 provides a low-level signal, and the second node PD1 is at a high level under the action of the first control circuit 500 and the second control circuit 600. When the fourth voltage terminal VDD2 provides a high-level signal, the first voltage terminal VDD1 provides a low-level signal, and the third node PD2 is at a high level under the action of the third control circuit 800 and the fourth control circuit 900. In this way, performance drift caused by the long-term turned-on of the transistors in the shift register unit 40 can be avoided. For example, the signal provided by the fourth voltage terminal VDD2 is referred to as a fourth voltage, which is the same in the following embodiments and is not described in detail.

It should be noted that, the shift register unit provided by some embodiments of the present disclosure may be obtained by combining the variable resistor 210 with a shift register unit of any arbitrary structure in general, and is not limited to the above-mentioned structural form. The resistance value of the variable resistor 210 in the bright state of illumination is smaller than the resistance value in the dark state, so that the level of the scanning signal output by the pixel signal output terminal OP1 in the bright state of illumination is higher than the level in the dark state, thereby adjusting the charging rate of the pixel unit, so that the charging effects of the pixel unit are the same or similar when the light intensity is different, which reduces or eliminates the horizontal stripes caused by the RC delay due to different light intensity.

Figure 5:
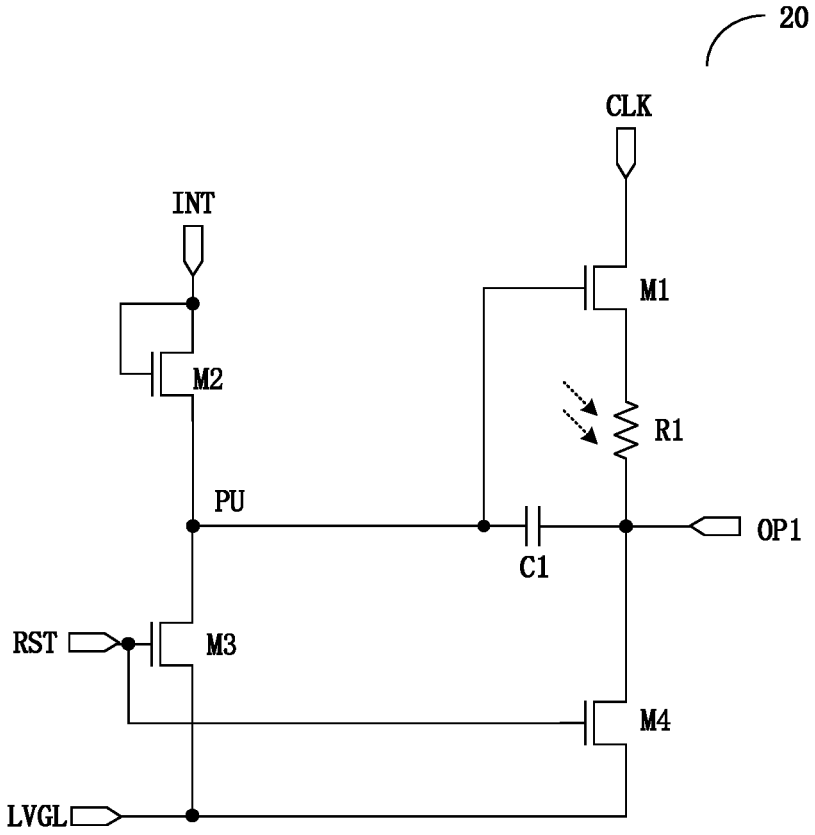
FIG. 5 is a circuit diagram of a specific implementation example of the shift register unit illustrated in FIG. 2.

FIG. 5 is a circuit diagram of a specific implementation example of the shift register unit illustrated in FIG. 2. In the following descriptions, each transistor is described by taking an N-type transistor as an example, but the embodiments of the present disclosure are not limited in this aspect. As illustrated in FIG. 5, the shift register unit 20 includes first to fourth transistors M1-M4 and a first capacitor C1, and further includes a photoresistor R1. For example, the shift register unit 20 is a combination of the photoresistor R1 and a normal 4T1C shift register unit.

The output circuit 200 may be implemented to include a first transistor M1, a first capacitor C, and a photoresistor R1. A gate electrode of the first transistor M1 is connected to the first node PU, a first electrode of the first transistor M1 is connected to the clock signal terminal CLK to receive the clock signal, and a second electrode of the first transistor M1 is connected to a first terminal of the photoresistor R1. A second terminal of the photoresistor R1 is connected to the pixel signal output terminal OP1. A first electrode of the first capacitor C1 is connected to the first node PU, and a second electrode of the first capacitor C1 is connected to the pixel signal output terminal OP. The aforementioned variable resistor 210 is implemented as the photoresistor R1, for example. When the first node PU is at a valid level (for example, a high level), the first transistor M1 is turned on, so that the first transistor M1 can receive the clock signal of the clock signal terminal CLK and output the scanning signal through the pixel signal output terminal OP1. When the light intensity changes, the resistance value of the photoresistor R1 changes, so that the level of the scanning signal output from the pixel signal output terminal OP changes, thereby achieving the purpose of adjusting the level of the scanning signal.

The input circuit 100 may be implemented as a second transistor M2. A gate electrode of the second transistor M2 is connected to a first electrode of the second transistor M2, and is connected to the input terminal INT to receive the input signal, and a second electrode of the second transistor M2 is connected to the first node PU. The second transistor M2 is turned on when the input signal of the input terminal INT is at a valid level (for example, a high level), and the input signal charges the first node PU to enable the first node PU to be at a high level.

The first node noise reduction circuit 300 may be implemented as a third transistor M3. A gate electrode of the third transistor M3 is connected to the noise reduction control signal terminal RST, a first electrode of the third transistor M3 is connected to the first node PU, and a second electrode of the third transistor M3 is connected to the second voltage terminal LVGL. When the noise reduction control signal of the noise reduction control signal terminal RST is at a valid level (for example, a high level), the third transistor M3 is turned on to electrically connect the first node PU and the second voltage terminal LVGL, so that the first Node PU is pulled down to be at a low level, so as to perform noise reduction.

The output noise reduction circuit 400 may be implemented as a fourth transistor M4. A gate electrode of the fourth transistor M4 is connected to the noise reduction control signal terminal RST, a first electrode of the fourth transistor M4 is connected to the pixel signal output terminal OP1, and a second electrode of the fourth transistor M4 is connected to the second voltage terminal LVGL. When the noise reduction control signal of the noise reduction control signal terminal RST is at a valid level (for example, a high level), the fourth transistor M4 is turned on to electrically connect the pixel signal output terminal OP1 and the second voltage terminal LVGL, so that the scanning signal of the pixel signal output terminal OP1 is pulled down to be at a low level, so as to perform noise reduction.

Figure 6:
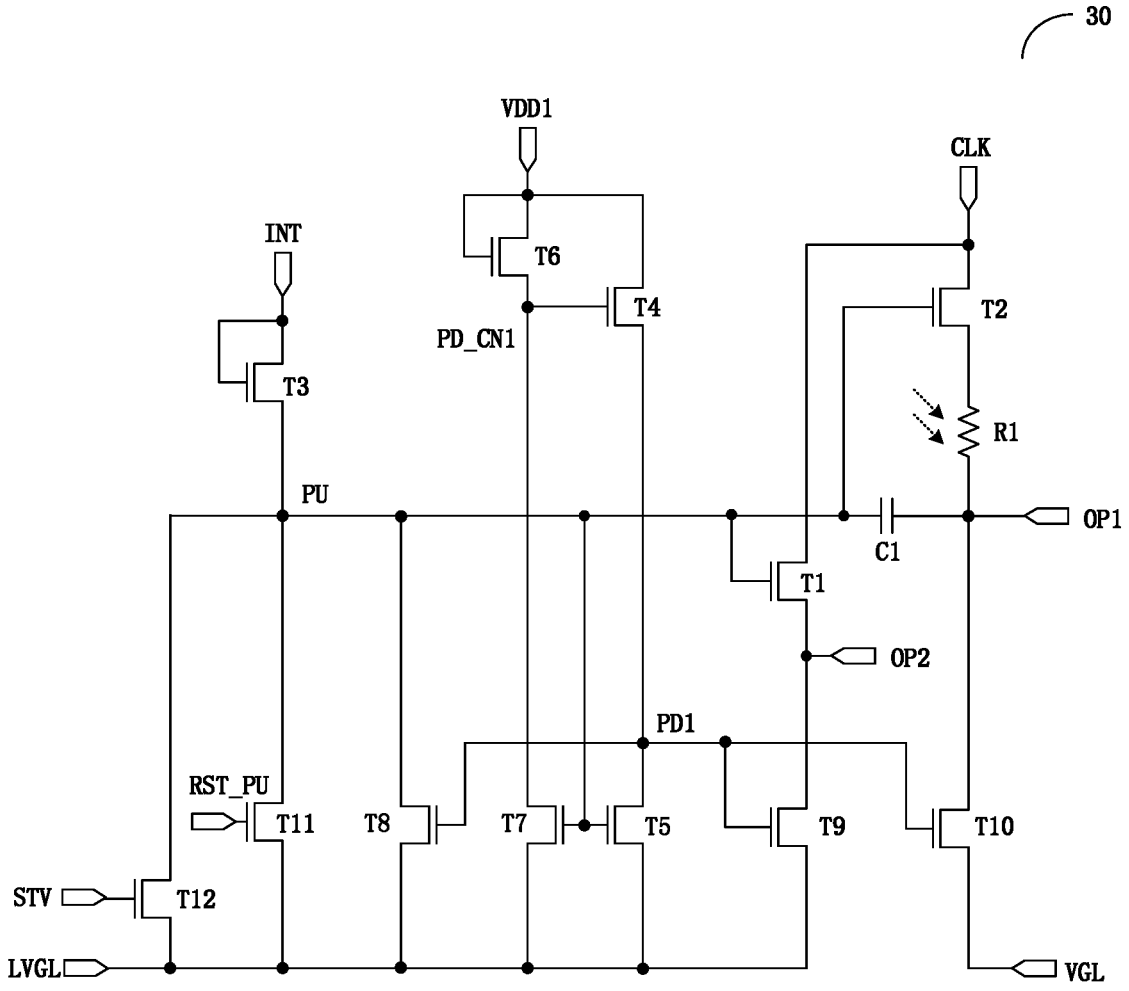
FIG. 6 is a circuit diagram of a specific implementation example of the shift register unit illustrated in FIG. 3.

FIG. 6 is a circuit diagram of a specific implementation example of the shift register unit illustrated in FIG. 3. As illustrated in FIG. 6, the shift register unit 30 includes first to twelfth transistors T1-T12 and a first capacitor C1, and further includes a photoresistor R1.

The output circuit 200 may be implemented to include a first transistor T1, a second transistor T2, a first capacitor C1, and a photoresistor R1. A gate electrode of the first transistor T1 is connected to the first node PU, a first electrode of the first transistor T1 is connected to the clock signal terminal CLK to receive the clock signal, and a second electrode of the first transistor T1 is connected to the shift signal output terminal OP2. A gate electrode of the second transistor T2 is connected to the first node PU, a first electrode of the second transistor T2 is connected to the clock signal terminal CLK to receive the clock signal, and a second electrode of the second transistor T2 is connected to a first terminal of the photoresistor R1. A first electrode of the first capacitor C1 is connected to the first node PU, and a second electrode of the first capacitor C1 is connected to the pixel signal output terminal OP. A second terminal of the photoresistor R1 is connected to the pixel signal output terminal OP1. The aforementioned variable resistor 210 is implemented as the photoresistor R1, for example.

When the first node PU is at a valid level (such as a high level), the first transistor T1 and the second transistor T2 are both turned on, so that the first transistor T1 and the second transistor T2 can receive the clock signal of the clock signal terminal CLK, the shift signal is outputted from the shift signal output terminal OP2, and the scanning signal is outputted from the pixel signal output terminal OP1. When the light intensity changes, the resistance value of the photoresistor R1 changes, so that the level of the scanning signal output from the pixel signal output terminal OP changes, thereby achieving the purpose of adjusting the level of the scanning signal. The shift signal output from the shift signal output terminal OP2 is not affected by the photoresistor R1, thereby avoiding the photoresistor R1 from affecting the normal function of the gate driving circuit that is formed by a plurality of cascaded shift register units 30.

The input circuit 100 may be implemented as a third transistor T3. A gate electrode of the third transistor T3 is connected to a first electrode of the third transistor T3, and is connected to the input terminal INT to receive the input signal, and a second electrode of the third transistor T3 is connected to the first node PU. When the input signal of the input terminal INT is at a valid level (for example, a high level), the third transistor T3 is turned on, and the input signal charges the first node PU to allow the first node PU to be at a high level.

The first control circuit 500 may be implemented to include a fourth transistor T4 and a fifth transistor T5. A gate electrode of the fourth transistor T4 is connected to the first control node PD_CN1, a first electrode of the fourth transistor T4 is connected to the first voltage terminal VDD1 to receive the first voltage, and a second electrode of the fourth transistor T4 is connected to the second node PD1. A gate electrode of the fifth transistor T5 is connected to the first node PU, a first electrode of the fifth transistor T5 is connected to the second node PD1, and a second electrode of the fifth transistor T5 is connected to the second voltage terminal LVGL to receive the second voltage.

The second control circuit 600 may be implemented to include a sixth transistor T6 and a seventh transistor T7. A gate electrode of the sixth transistor T6 is connected to a first electrode of the sixth transistor T6, and is connected to the first voltage terminal VDD1 to receive the first voltage, and a second electrode of the sixth transistor T6 is connected to the first control node PD_CN1. A gate electrode of the seventh transistor T7 is connected to the first node PU, a first electrode of the seventh transistor T7 is connected to the first control node PD_CN1, and a second electrode of the seventh transistor T7 is connected to the second voltage terminal LVGL to receive the second voltage.

The first node noise reduction circuit 300 may be implemented as an eighth transistor T8. A gate electrode of the eighth transistor T8 is connected to the second node PD1, a first electrode of the eighth transistor T8 is connected to the first node PU, and a second electrode of the eighth transistor T8 is connected to the second voltage terminal LVGL to receive the second voltage. When the second node PD1 is at a valid level (such as a high level), the eighth transistor T8 is turned on to electrically connect the first node PU and the second voltage terminal LVGL, so that the first node PU can be pulled down to reduce noise.

The output noise reduction circuit 400 may be implemented to include a ninth transistor T9 and a tenth transistor T10. A gate electrode of the ninth transistor T9 is connected to the second node PD1, a first electrode of the ninth transistor T9 is connected to the shift signal output terminal OP2, and a second electrode of the ninth transistor T9 is connected to the second voltage terminal LVGL to receive the second voltage. A gate electrode of the tenth transistor T10 is connected to the second node PD1, a first electrode of the tenth transistor T10 is connected to the pixel signal output terminal OP1, and a second electrode of the tenth transistor T10 is connected to the third voltage terminal VGL to receive the third voltage. When the second node PD1 is at a valid level (for example, a high level), the ninth transistor T9 is turned on to electrically connect the shift signal output terminal OP2 and the second voltage terminal LVGL, and the tenth transistor T10 is turned on to electrically connect the pixel signal output terminal OP1 and the third voltage terminal VGL, so that the shift signal output terminal OP2 and the pixel signal output terminal OP1 can be pulled down respectively to reduce noise.

The first reset circuit 710 may be implemented as an eleventh transistor T11. A gate electrode of the eleventh transistor T11 is connected to the first reset terminal RST_PU to receive the first reset signal, a first electrode of the eleventh transistor T11 is connected to the first node PU, and a second electrode of the eleventh transistor T11 is connected to the second voltage terminal LVGL to receive the second voltage. When the first reset signal of the first reset terminal RST_PU is at a valid level (for example, a high level), the eleventh transistor T11 is turned on to electrically connect the first node PU and the second voltage terminal LVGL, thereby resetting the first node PU.

The second reset circuit 720 may be implemented as a twelfth transistor T12. A gate electrode of the twelfth transistor T12 is connected to the second reset terminal STV to receive the second reset signal, a first electrode of the twelfth transistor T12 is connected to the first node PU, and a second electrode of the twelfth transistor T12 is connected to the second voltage terminal LVGL. When the second reset signal of the second reset terminal STV is at a valid level (for example, a high level), the twelfth transistor T12 is turned on to electrically connect the first node PU and the second voltage terminal LVGL, thereby resetting the first node PU.

Figure 7:
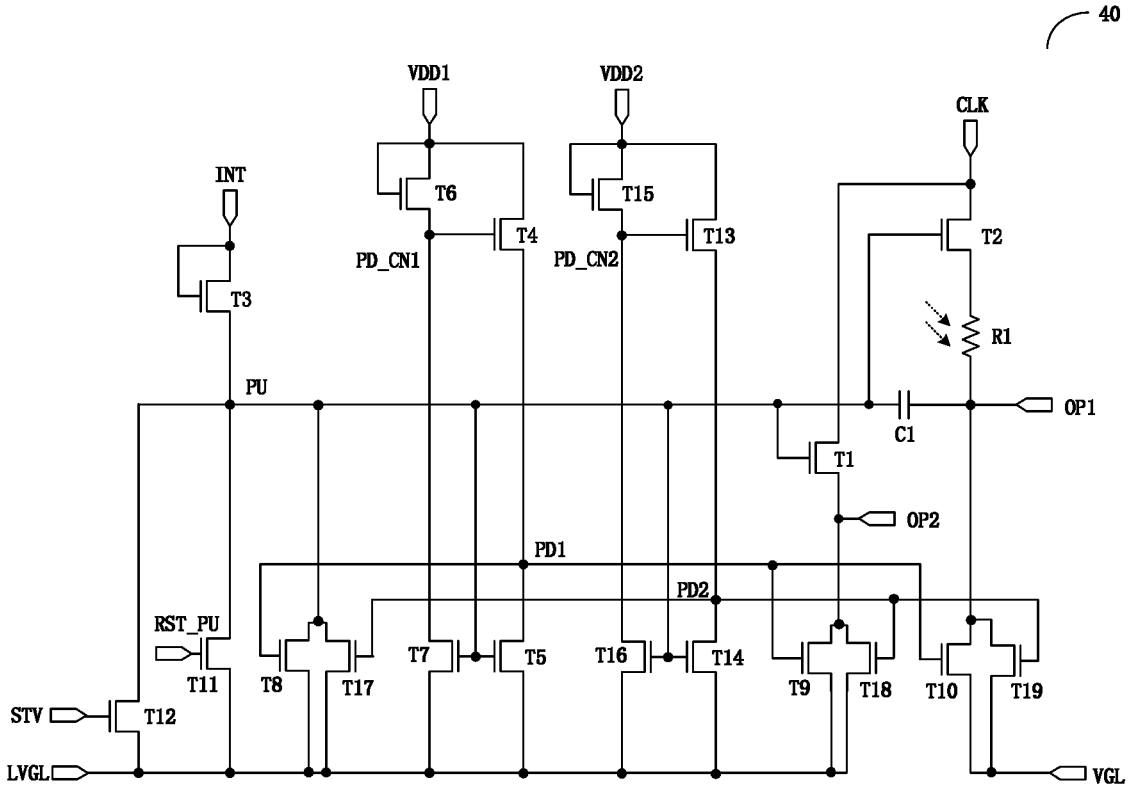
FIG. 7 is a circuit diagram of a specific implementation example of the shift register unit illustrated in FIG. 4.

FIG. 7 is a circuit diagram of a specific implementation example of the shift register unit illustrated in FIG. 4. As illustrated in FIG. 7, the shift register unit 40 includes first to nineteenth transistors T1-T19 and a first capacitor C1, and further includes a photoresistor R1. Compared with the shift register unit 30 illustrated in FIG. 6, in addition to further including the thirteenth to nineteenth transistors T13-T19, the connection manner of the other transistors, capacitor, and resistor in the shift register unit 40 are the same as the connection manner of the shift register unit 30 illustrated in FIG. 6, which is not repeated here for simplicity.

The third control circuit 800 may be implemented to include a thirteenth transistor T13 and a fourteenth transistor T14. A gate electrode of the thirteenth transistor T13 is connected to the second control node PD_CN2, a first electrode of the thirteenth transistor T13 is connected to the fourth voltage terminal VDD2 to receive the fourth voltage, and a second electrode of the thirteenth transistor T13 is connected to the third node PD2. A gate electrode of the fourteenth transistor T14 is connected to the first node PU, a first electrode of the fourteenth transistor T14 is connected to the third node PD2, and a second electrode of the fourteenth transistor T14 is connected to the second voltage terminal LVGL to receive the second voltage.

The fourth control circuit 900 may be implemented to include a fifteenth transistor T15 and a sixteenth transistor T16. A gate electrode of the fifteenth transistor T15 is connected to a first electrode of the fifteenth transistor T15, and is connected to the fourth voltage terminal VDD2 to receive the fourth voltage, and a second electrode of the fifteenth transistor T15 is connected to the second control node PD_CN2. A gate electrode of the sixteenth transistor T16 is connected to the first node PU, a first electrode of the sixteenth transistor T16 is connected to the second control node PD_CN2, and a second electrode of the sixteenth transistor T16 is connected to the second voltage terminal LVGL to receive the second voltage.

The first node noise reduction circuit 300 may be implemented to include an eighth transistor T8 and a seventeenth transistor T17. The connection manner of the eighth transistor T8 is similar to that of the eighth transistor T8 in the shift register unit 30 illustrated in FIG. 6 and is not repeated here. A gate electrode of the seventeenth transistor T17 is connected to the third node PD2, a first electrode of the seventeenth transistor T17 is connected to the first node PU, and a second electrode of the seventeenth transistor T17 is connected to the second voltage terminal LVGL to receive the second voltage. When any one of the second node PD1 and the third node PD2 is at a valid level (for example, a high level), the eighth transistor T8 or the seventeenth transistor T17 is turned on to electrically connect the first node PU and the second voltage terminal LVGL, so that the first node PU can be pulled down to reduce noise.

The output noise reduction circuit 400 may be implemented to include a ninth transistor T9, a tenth transistor T10, an eighteenth transistor T18, and a nineteenth transistor T19. The connection manners of the ninth transistor T9 and the tenth transistor T10 are similar to those of the ninth transistor T9 and the tenth transistor T10 in the shift register unit 30 illustrated in FIG. 6 and are not repeated here. A gate electrode of the eighteenth transistor T18 is connected to the third node PD2, a first electrode of the eighteenth transistor T18 is connected to the shift signal output terminal OP2, and a second electrode of the eighteenth transistor T18 is connected to the second voltage terminal LVGL to receive the second voltage. A gate electrode of the nineteenth transistor T19 is connected to the third node PD2, a first electrode of the nineteenth transistor T19 is connected to the pixel signal output terminal OP1, and a second electrode of the nineteenth transistor T19 is connected to the third voltage terminal VGL to receive the third voltage. When any one of the second node PD1 and the third node PD2 is at a valid level (for example, a high level), the ninth transistor T9 or the eighteenth transistor T18 is turned on to electrically connect the shift signal output terminal OP2 and the second voltage terminal LVGL, and the tenth transistor T10 or the nineteenth transistor T19 is turned on to electrically connect the pixel signal output terminal OP1 and the third voltage terminal VGL, thereby achieving noise reduction by performing pulling down.

It should be noted that in the embodiments of the present disclosure, the first capacitor C1 may be a capacitor component manufactured by a manufacturing process, for example, by manufacturing a dedicated capacitor electrode. Each electrode of the capacitor may be implemented by a metal layer, a semiconductor layer (e.g., doped polysilicon) and the like. Alternatively, the first capacitor C1 may also be a parasitic capacitance between transistors, which can be implemented by the transistor itself and other devices and wirings.

It should be noted that in the description of the embodiments of the present disclosure, the first node PU, the second node PD1, the third node PD2, the first control node PD_CN1 and the second control node PD_CN2 do not represent actual components, but represent meeting points of related electrical connections in the circuit diagram.

It should be noted that each of the transistors used in the embodiments of the present disclosure may be a thin film transistor, a field effect transistor or other switching component having the same characteristics. In the embodiments of the present disclosure, the thin film transistor is taken as an example for description. The source electrode and drain electrode of the transistor used here may be structurally symmetrical, so that the source electrode and the drain electrode may be indistinguishable in structure. In the embodiments of the present disclosure, in order to distinguish the two electrodes of the transistor except the gate electrode, one electrode is directly described as the first electrode, and the other electrode is described as the second electrode.

In addition, the transistors in the embodiments of the present disclosure are all described by taking N-type transistors as an example. In this case, the first electrode of the transistor is the drain electrode, and the second electrode is the source electrode. It should be noted that the present disclosure includes but is not limited to this case. For example, one or more transistors in the shift register unit 10/20/30/40 provided by the embodiments of the present disclosure may also adopt P-type transistors. In this case, the first electrode of the transistor is the source electrode, and the second electrode is the drain electrode, as long as the electrodes of the selected type of transistors are connected with reference to the electrodes of the corresponding transistors in the embodiments of the present disclosure, and the corresponding voltage terminals are provided with corresponding high voltage or low voltage. In the case where the N-type transistors are adopted, indium gallium zinc oxide (IGZO) may be adopted as an active layer of the thin film transistor, and compared with the thin film transistor which adopts low temperature polysilicon (LTPS) or amorphous silicon (for example, hydrogenated amorphous silicon) as the active layer, the size of the transistor can be effectively reduced and leakage current can be prevented.

In the embodiments of the present disclosure, for example, in the case where each circuit is implemented by N-type transistors, the term "pull-up" means charging a node or an electrode of a transistor to allow the absolute value of the level of the node or the electrode to be increased, so as to implement a corresponding operation (e.g., turn-on) of the transistor, and the term "pull-down" means discharging a node or an electrode of a transistor to allow the absolute value of the level of the node or the electrode to be reduced, so as to implement a corresponding operation (e.g., turn-off) of the transistor. For another example, in the case where each circuit is implemented by P-type transistors, the term "pull-up" means discharging a node or an electrode of a transistor to allow the absolute value of the level of the node or the electrode to be reduced, so as to implement a corresponding operation (e.g., turn-on) of the transistor; and the term "pull-down" means charging a node or an electrode of a transistor to allow the absolute value of the level of the node or the electrode to be increased, so as to implement a corresponding operation (e.g., turn-off) of the transistor.

Figure 8:
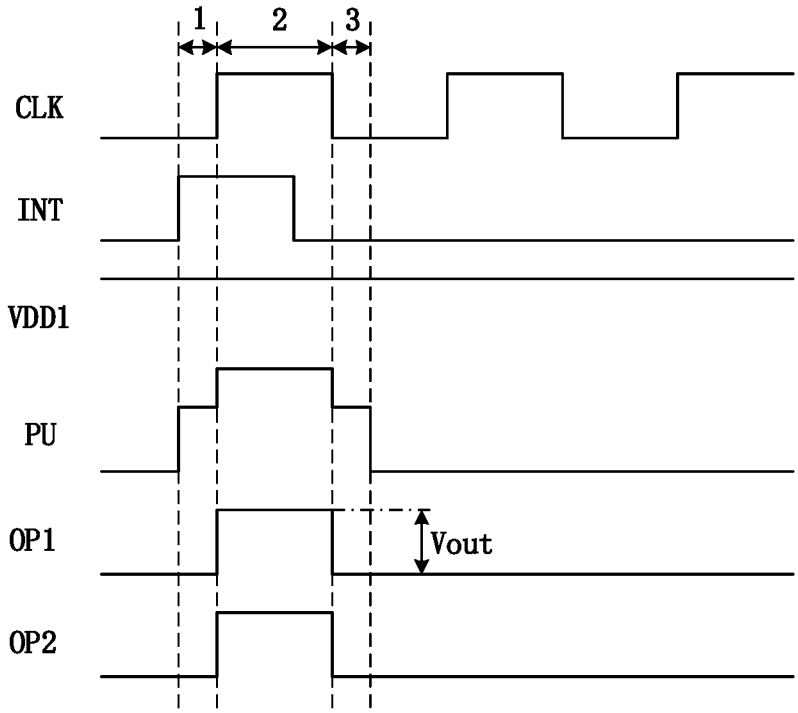
FIG. 8 is a signal timing diagram of a shift register unit provided by some embodiments of the present disclosure.

FIG. 8 is a signal timing diagram of a shift register unit provided by some embodiments of the present disclosure. The working principle of the shift register unit 30 illustrated in FIG. 6 is described below with reference to the signal timing diagram illustrated in FIG. 8, and each transistor is described by taking an N-type transistor as an example, but the embodiments of the present disclosure are not limited thereto.

In FIG. 8 and the following description, CLK, INT, VDD1, VDD2, PU, OP1, OP2, etc. are used to indicate a corresponding signal terminal or a corresponding node, and also used to indicate the level of the corresponding signal or the corresponding node. The embodiments are the same as this which may not be repeated herein. In the first phase to the third phase 1-3 illustrated in FIG. 8, the shift register unit 30 may perform the following operations, respectively.

In a first phase 1, the input terminal INT provides a high-level signal, the third transistor T3 is turned on, and the first node PU is charged to be at a high level. The first transistor T1 and the second transistor T2 are both turned on. The first transistor T1 outputs the clock signal of the clock signal terminal CLK to the shift signal output terminal OP2, the second transistor T2 outputs the clock signal to the first terminal of the photoresistor R1, and the second terminal of the photoresistor R2 outputs the scanning signal through the pixel signal output terminal OP. At this time, the clock signal is at a low level, so the shift signal output terminal OP2 and the pixel signal output terminal OP1 both output the low level. The first voltage terminal VDD1 provides a high-level signal, and the sixth transistor T6 is turned on. The fifth transistor T5 and the seventh transistor T7 are turned on under the action of the high level of the first node PU. Because the sixth transistor T6 and the seventh transistor T7 are in series to divide voltage, the first control node PD_CN1 is pulled down to be at a low level. The fourth transistor T4 is turned off, and the second node PD1 is pulled down to be at a low level by the fifth transistor T5 that is turned on. The eighth transistor T8, the ninth transistor T9, and the tenth transistor T10 are all turned off.

In a second phase 2, the clock signal of the clock signal terminal CLK becomes a high level, the potential of the first node PU is further increased due to the coupling effect of the clock signal (for example, based on the bootstrap effect of the first capacitor C1), and the first transistor T1 and the second transistor T2 are fully turned on, the high level of the clock signal is output to the shift signal output terminal OP2 as the shift signal, and the high level of the clock signal is also transmitted to the first terminal of the photoresistor R1. Through the action of the photoresistor R1, the pixel signal output terminal OP1 outputs the scanning signal with a high level. Due to the presence of the photoresistor R1, the high level of the scanning signal is different from the high level of the shift signal. In the case where the light intensity is sufficiently high, the resistance value of the photoresistor R1 is very small, so the high level of the scanning signal and the high level of the shift signal can also be approximately equal, for example, both approximately equal to the high level of the clock signal. The second node PD1 remains at a low level, and the eighth transistor T8, the ninth transistor T9, and the tenth transistor T10 remain to be turned off, which do not affect the output.

In a third phase 3, the clock signal of the clock signal terminal CLK becomes a low level, the potential of the first node PU is decreased due to the coupling effect of the clock signal (for example, based on the bootstrap effect of the first capacitor C1) but is still at a high level, the first transistor T1 and the second transistor T2 remain to be turned on, the low level of the clock signal is output to the shift signal output terminal OP2, and the low level of the clock signal is also transmitted to the first terminal of the photoresistor R1. Through the action of the photoresistor R1, the pixel signal output terminal OP1 outputs the scanning signal with a low level.

In subsequent phases, the first reset terminal RST_PU provides a high-level signal (not illustrated in FIG. 8), and the eleventh transistor T11 is turned on to pull down the level of the first node PU to a low level. The fifth transistor T5 and the seventh transistor T7 are turned off. The first control node PD_CN1 is pulled up to be at a high level by the sixth transistor T6, and the fourth transistor T4 is turned on to pull up the second node PD1 to be at a high level. The eighth transistor T8, the ninth transistor T9, and the tenth transistor T10 are all turned on, thereby continuously performing noise reduction on the first node PU, the shift signal output terminal OP2, and the pixel signal output terminal OP, respectively.

The level of the scanning signal output from the pixel signal output terminal OP1 is Vout, and the level Vout may change with the change of the resistance value of the photoresistor R1, that is, may change with the change of the light intensity.

Figure 9A:
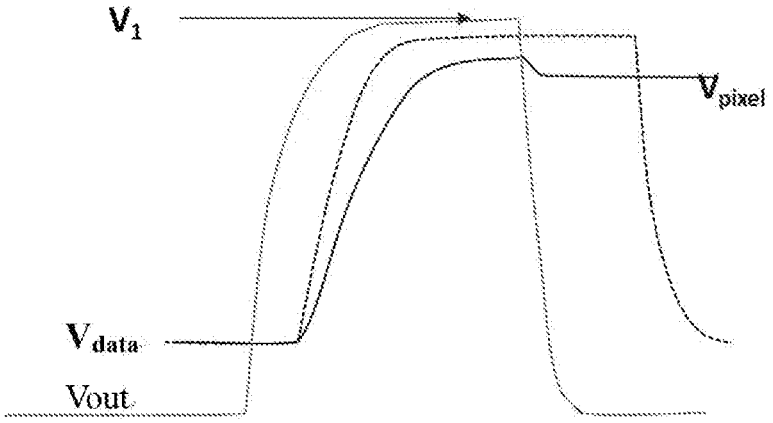
FIG. 9A is a signal diagram of a shift register unit provided by some embodiments of the present disclosure in the case where the shift register unit is not illuminated.

In the case where the photoresistor R1 is not illuminated or the illumination is weak, that is, in the dark state, the RC Delay when writing the data signal Vdata into the pixel unit is relatively small, and in this case, the resistance value R of the photoresistor R1 is relatively large. The level (amplitude) of the scanning signal that is outputted is Vout=V1, the charging rate of the pixel unit is n %, the voltage of the signal which is written into the pixel unit is Vpixel, and various signals are illustrated in FIG. 9A. In this case, the level V1 of the scanning signal can be expressed as:

$$V1=V_{CLK}-I_{on\text{-}dark(T2)}\times R,$$

in which $V_{CLK}$ represents the level of the clock signal, and $I_{on\text{-}dark(T2)}$ represents the turned-on current of the second transistor T2 in the dark state.

Figure 9B:
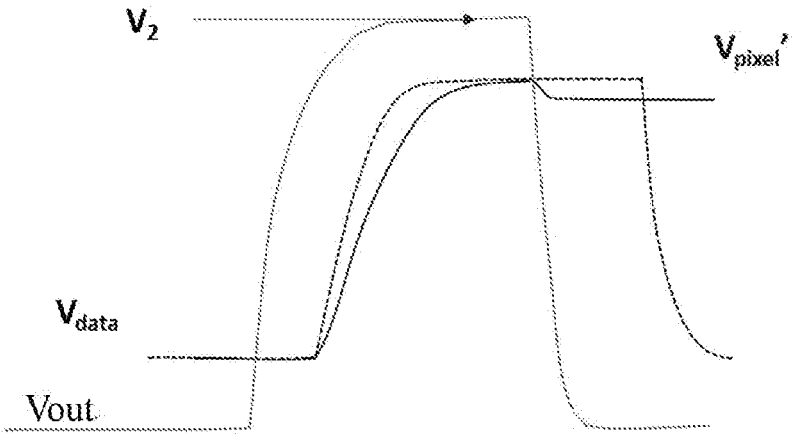
FIG. 9B is a signal diagram of a shift register unit provided by some embodiments of the present disclosure in the case where the shift register unit is illuminated.

In the case where the photoresistor R1 is illuminated, that is, in the bright state of illumination, the RC Delay when writing the data signal Vdata into the pixel unit increases due to the influence of the active layer, and in this case, the resistance value R' of the photoresistor R1 is relatively small due to the illumination. The level (amplitude) of the scanning signal that is outputted is Vout=V2, the charging rate of the pixel unit is m %, the voltage of the signal which is written into the pixel unit is Vpixel', and various signals are illustrated in FIG. 9B. For example, the charging rate m % in the bright state of illumination is greater than the charging rate n % in the dark state. In this case, the level V2 of the scanning signal can be expressed as:

$$V2=V_{CLK}-I_{on\text{-}photo(T2)}\times R',$$

in which $V_{CLK}$ represents the level of the clock signal, and $I_{on\text{-}photo(T2)}$ represents the turned-on current of the second transistor T2 in the bright state of illumination.

Due to the action of the photoresistor R1, V2>V1. The RC Delay in the bright state of illumination is different from the RC Delay in the dark state, and the different levels V1 and V2 of the scanning signal can adjust the gate voltage of the switching transistor of the pixel unit connected to the pixel signal output terminal OP1, thereby adjusting the conduction degree of the switching transistor and controlling the charging rate of the pixel unit, so that in the case where the level of the scanning signal is the V1 with a smaller value, the conduction degree of the switching transistor is lower, and the charging rate of the pixel unit is lower, and in the case where the level of the scanning signal is the V2 with a larger value, the conduction degree of the switching transistor is higher, and the charging rate of the pixel unit is higher. By controlling the charging rate of the pixel unit, the influence of the RC Delay on the charging effect of the pixel unit can be alleviated, so that the signal voltage Vpixel' in the bright state of illumination is equal to or approximately equal to the signal voltage Vpixel in the dark state, so as to reduce or eliminate horizontal stripes caused by RC Delay due to different light intensity, and to improve the quality of the display picture.

Figure 10:
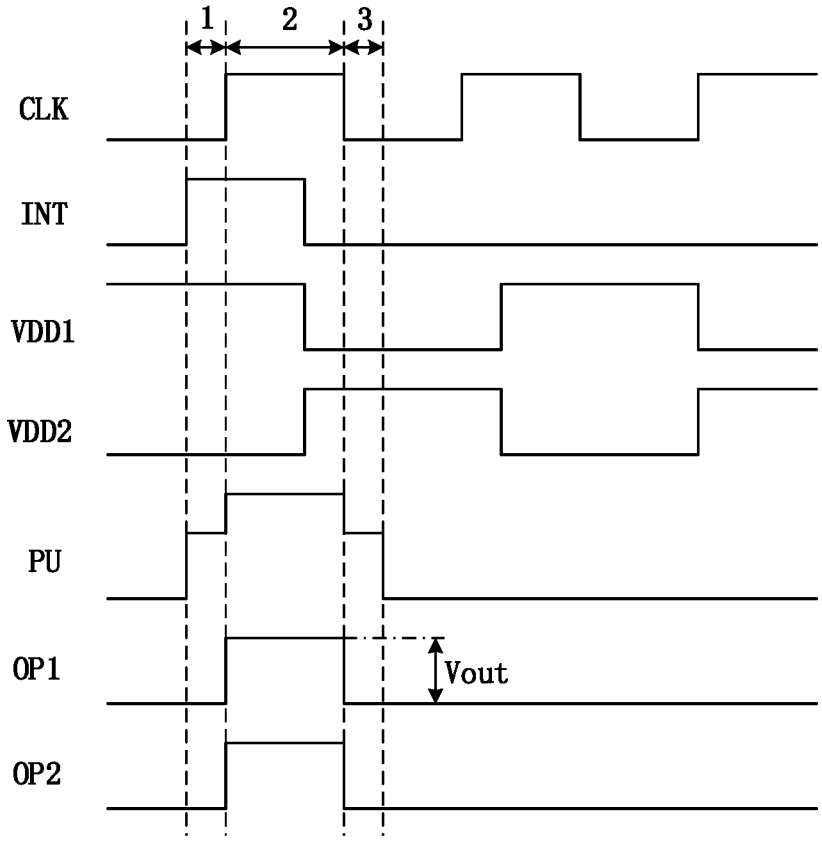
FIG. 10 is a signal timing diagram of another shift register unit provided by some embodiments of the present disclosure.

FIG. 10 is a signal timing diagram of another shift register unit provided by some embodiments of the present disclosure. The signal timing illustrated in this signal timing diagram can be used, for example, to drive the shift register unit 40 illustrated in FIG. 7. Different from the signal timing illustrated in FIG. 8, in this embodiment, the first voltage terminal VDD1 and the fourth voltage terminal VDD2 are configured to alternately provide a DC high-level signal. Therefore, after the end of the third phase 3, the second node PD1 and the third node PD2 are alternately to be at a high level, thereby controlling a group of transistors including the eighth transistor T8, the ninth transistor T9, and the tenth transistor T10 and a group of transistors including the seventeenth T17, the eighteenth transistor T18, and the nineteenth transistor T19 to be turned on alternately, so as to perform pulling down and noise reduction on the first node PU, the shift signal output terminal OP2, and the pixel signal output terminal OP1, respectively. The working principle of the shift register unit 40 in the first phase 1 to the third phase 3 can be referred to the foregoing content, which is not repeated here for simplicity.

At least one embodiment of the present disclosure further provides a gate driving circuit. The gate driving circuit includes the shift register unit provided by any one of the embodiments of the present disclosure. The gate driving circuit can enable the level of the scanning signal in the bright state of illumination to be higher than the level in the dark state, thereby adjusting the charging rate of the pixel unit, so that the charging effects of the pixel unit are the same or similar when the light intensity is different, which reduces or eliminates the horizontal stripes caused by the RC delay due to different light intensity.

Figure 11:
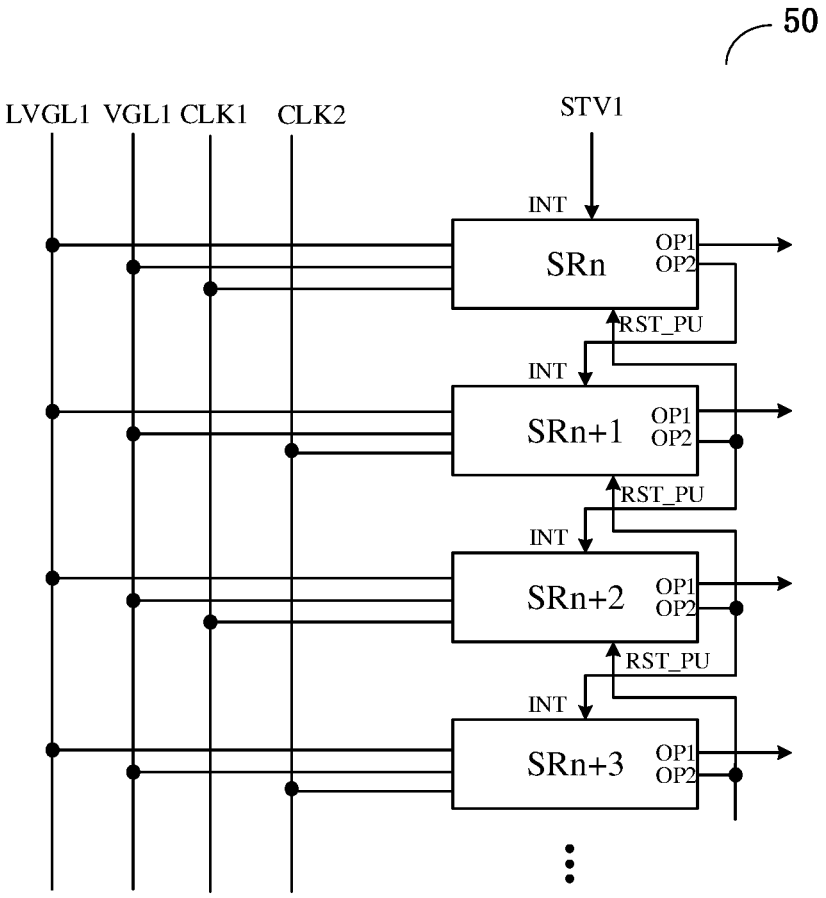
FIG. 11 is a schematic block diagram of a gate driving circuit provided by some embodiments of the present disclosure.

FIG. 11 is a schematic block diagram of a gate driving circuit provided by some embodiments of the present disclosure. As illustrated in FIG. 11, a gate driving circuit 50 includes a plurality of cascaded shift register units (SRn, SRn+1, SRn+2, SRn+3, etc.). The number of the plurality of shift register units is not limited, and can be determined according to actual needs. For example, the shift register unit adopts the shift register unit 10/20/30/40 provided by any one of the embodiments of the present disclosure. For example, in the gate driving circuit 50, part or all of the shift register units may adopt the shift register unit 10/20/30/40 provided by any one of the embodiments of the present disclosure. The gate driving circuit 50 can be directly integrated on the array substrate of the display device by using the same manufacturing process as the thin film transistor to form a GOA circuit, thereby implementing the progressive scanning driving function.

For example, each of the plurality of shift register units includes the input terminal INT, the first reset terminal RST_UP, the pixel signal output terminal OP1, and the shift signal output terminal OP2, and for the sake of conciseness, other signal terminals that should be included are not illustrated or marked in the figure. For example, except the first-stage shift register unit, the shift signal output terminal OP2 of each stage of the shift register units is connected to the first reset terminal RST_UP of the shift register unit of the preceding stage. For example, except the last-stage shift register unit, the shift signal output terminal OP2 of each stage of the shift register units is connected to the input terminal INT of the shift register unit of the next stage. For example, the input terminal NT of the first-stage shift register unit is configured to receive a trigger signal STV1; and the first reset terminal RST_UP of the last-stage shift register unit is configured to receive a reset signal provided additionally. Of course, the above case is the case of forward scanning. In the case of backward scanning, the trigger signal STV1 for the first-stage shift register unit is replaced with the reset signal, and the above reset signal, which is used for the last-stage shift register unit, is replaced with the trigger signal STV1. In addition, the shift signal output signal OP2 of each stage of the shift register units is connected to the input terminal INT of the shift register unit of the preceding stage, and the shift signal output terminal OP2 of each stage of the shift register units is connected to the first reset terminal RST_UP of the shift register unit of the next stage.

For example, the gate driving circuit 50 further includes a first system clock CLK1 and a second system clock CLK2, and the clock signals output by the first system clock CLK1 and the second system clock CLK2 are complementary to each other. For example, shift register units of odd-numbered stages (for example, SRn and SRn+2) are connected to the first system clock CLK1 to receive a clock signal, and shift register units of even-numbered stages (for example, SRn+1 and SRn+3) are connected to the second system clock CLK2 to receive a clock signal, so as to ensure that the respective output signals of the pixel signal output terminal OP1 and the shift signal output terminal OP2 of each shift register unit are shifted. For example, the gate driving circuit 50 may further include a timing controller, for example, the timing controller is configured to provide the first system clock signal and the second system clock signal to the shift register units of all stages, and the timing controller may be further configured to provide the trigger signal STV1. In different examples, according to different configurations, more system clocks may be provided, such as 4, 6, etc.

It should be noted that in the embodiments of the present disclosure, the cascading manner of the shift register units of all stages in the gate driving circuit 50 and the connection manner with the system clocks are not limited, which may be the above manner or other suitable connection manners, and the embodiments of the present disclosure are not limited in this aspect.

For example, the gate driving circuit 50 further includes a second voltage line LVGL1, a third voltage line VGL1, and other voltage lines not illustrated in the figure, so as to provide the second voltage, the third voltage, and other required voltages to the shift register units.

For example, in the case where the gate driving circuit 50 is used to drive a display panel, the gate driving circuit 50 may be provided on one side of the display panel. For example, the display panel includes rows of gate lines, and the pixel signal output terminals OP1 of the shift register units in the gate driving circuit 50 can be configured to be sequentially connected to the rows of gate lines for outputting scanning signals. Of course, the gate driving circuits 50 may also be provided on both sides of the display panel to achieve a bilateral driving. The embodiments of the present disclosure do not limit the setting manner of the gate driving circuit 50. For example, in the case of bilateral driving, a gate driving circuit 50 may be provided on one side of the display panel for driving odd rows of gate lines, and another gate driving circuit 50 may be provided on the other side of the display panel for driving even rows of gate lines.

At least one embodiment of the present disclosure further provides a display device. The display device includes the gate driving circuit provided by any one of the embodiments of the present disclosure or a display panel including the gate driving circuit. The display panel has a backlight, and the backlight provides display light for the display panel. The gate driving circuit in the display device can enable the level of the scanning signal in the bright state of illumination to be higher than the level in the dark state, thereby adjusting the charging rate of the pixel unit, so that the charging effects of the pixel unit are the same or similar when the light intensity is different, which reduces or eliminates the horizontal stripes caused by the RC delay due to different light intensity.

Figure 12:
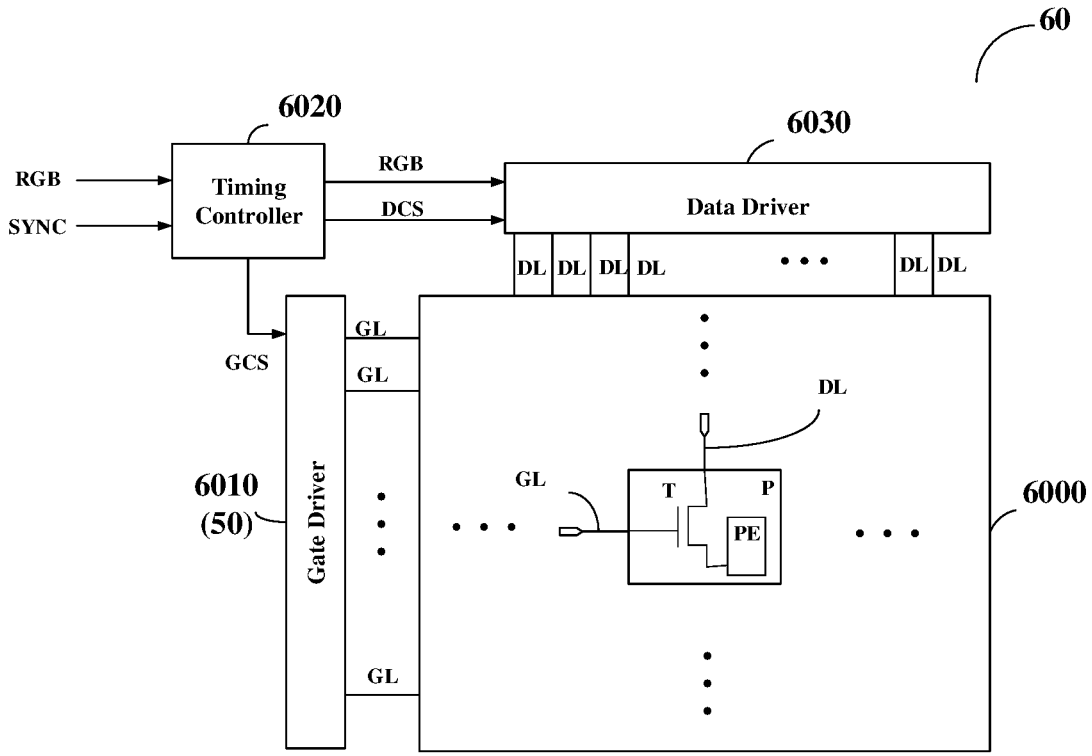
FIG. 12 is a schematic block diagram of a display device provided by some embodiments of the present disclosure.

FIG. 12 is a schematic block diagram of a display device provided by some embodiments of the present disclosure. As illustrated in FIG. 12, a display device 60 includes a gate driving circuit 50, which is the gate driving circuit provided by any one of the embodiments of the present disclosure. For example, the display device 60 may be any products or members having a display function, such as a liquid crystal panel, a liquid crystal television, a display, an electronic paper display device, a mobile phone, a tablet computer, a notebook computer, a digital photo frame, a navigator, etc., and the embodiments of the present disclosure are not limited in this aspect. For the technical effect of the display device 60, reference may be made to the corresponding descriptions of the shift register unit 10/20/30/40 and the gate driving circuit 50 in the foregoing embodiments, and details are not described here.

For example, in an example, the display device 60 includes a display panel 6000, a gate driver 6010, a timing controller 6020, and a data driver 6030. The display panel 6000 includes a plurality of pixel units P defined by the intersection of a plurality of gate lines GL and a plurality of data lines DL; the gate driver 6010 is used to drive the plurality of gate lines GL; the data driver 6030 is used to drive the plurality of data lines DL; and the timing controller 6020 is used to process image data RGB input from outside the display device 60, provide the image data RGB that is processed to the data driver 6030, and output scanning control signals GCS and data control signals DCS to the gate driver 6010 and the data driver 6030, respectively, so as to control the gate driver 6010 and the data driver 6030.

Each pixel unit P includes a switching transistor T and a pixel electrode PE. A gate electrode of the switching transistor T is electrically connected to the gate line GL, one of a source electrode and a drain electrode of the switching transistor T is electrically connected to the data line DL, and the other one of the source electrode and the drain electrode of the switching transistor T is electrically connected to the pixel electrode PE. The pixel electrode PE forms a liquid crystal capacitor together with a common electrode and a liquid crystal layer on the array substrate. In the case where the gate electrode of the switching transistor T is provided with a scanning signal to turn on the switching transistor, the data line DL is electrically connected to the pixel electrode PE, so that the data signal applied on the data line DL can charge the pixel electrode PE (that is, charge the liquid crystal capacitor). The level of the scanning signal applied to the gate electrode of the switching transistor T higher, the conduction degree of the switching transistor T greater, and the voltage of the pixel electrode PE is closer to the voltage of the data signal after charging, so that the charging rate of the pixel unit is higher.

For example, the gate driver 6010 includes the gate driving circuit 50 provided by any one of the above embodiments. The pixel signal output terminals OP1 of the plurality of shift register units 10/20/30/40 in the gate driving circuit 50 are correspondingly connected to the plurality of gate lines GL. The plurality of gate lines GL are correspondingly connected to the pixel units P arranged in rows. The pixel signal output terminal OP1 of the shift register units 10/20/30/40 in the gate driving circuit 50 sequentially output signals to the plurality of gate lines GL, so that the rows of pixel units P in the display panel 40 can perform a progressive scanning. For example, the gate driver 6010 may be implemented as a semiconductor chip, or may be integrated in the display panel 6000 to form a GOA circuit.

For example, the data driver 6030 converts the digital image data RGB input from the timing controller 6020 into a data signal, by using a reference gamma voltage, according to a plurality of data control signals DCS from the timing controller 6020. The data driver 6030 provides the converted data signals to the plurality of data lines DL. For example, the data driver 6030 may be implemented as a semiconductor chip.

For example, the timing controller 6020 processes the image data RGB input from the outside to match the size and resolution of the display panel 6000, and then provides the processed image data to the data driver 6030. The timing controller 6020 generates a plurality of scanning control signals GCS and a plurality of data control signals DCS by using synchronization signals (for example, a dot clock DCLK, a data enable signal DE, a horizontal synchronization signal Hsync, and a vertical synchronization signal Vsync) input from the outside of the display device 60. The timing controller 6020 provides the scanning control signals GCS and the data control signals DCS to the gate driver 6010 and the data driver 6030, respectively, for controlling the gate driver 6010 and the data driver 6030.

The display device 60 may further include other components, for example, a signal decoding circuit, a voltage conversion circuit, and the like. These components may adopt existing conventional components, for example, and are not described in detail here.

Figure 13:
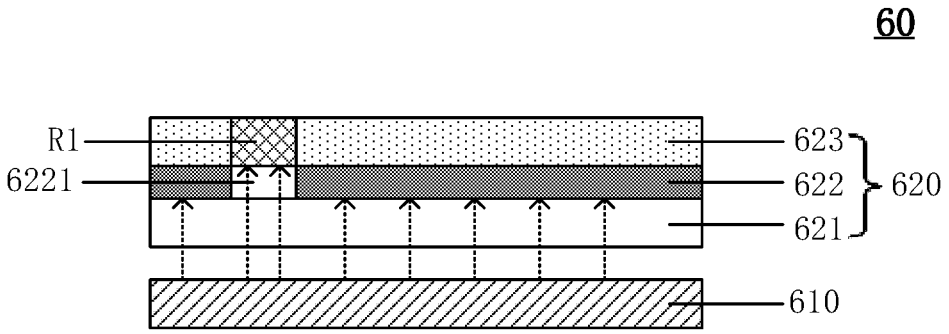
FIG. 13 is a schematic cross-sectional diagram of a display device provided by some embodiments of the present disclosure.

FIG. 13 is a schematic cross-sectional diagram of a display device provided by some embodiments of the present disclosure. For example, as illustrated in FIG. 13, in an example, the display device 60 further includes a backlight 610 and an array substrate 620. The array substrate 620 includes a base substrate 621, a light blocking layer 622, and a gate driving circuit layer 623.

The light blocking layer 622 is provided on the base substrate 621, the gate driving circuit layer 623 is provided on a side, away from the base substrate 621, of the light blocking layer 622, and the aforementioned gate driving circuit 50 is provided in the gate driving circuit layer 623. Therefore, the gate driving circuit layer 623 includes the shift register unit 10/20/30/40 provided by any one of the embodiments of the present disclosure, that is, the gate driving circuit layer 623 includes the variable resistor 210 (e.g., the photoresistor R1). The light blocking layer 622 has an opening 6221 at a position corresponding to the photoresistor R1, so that the light emitted by the backlight 610 can be irradiated to the photoresistor R1 through the opening 6221, but cannot be irradiated to other transistors in the shift register unit 10/20/30/40, so as to avoid adversely affecting the performance of these transistors. For example, the opening 6221 may mean that no light-blocking material is deposited in the corresponding region, or a transparent insulating material is deposited in the corresponding region. The embodiments of the present disclosure do not limit the position and material of the light blocking layer 622, and for example, the light blocking layer 622 may also be formed on a surface of a side of the base substrate 621 facing the backlight 610, for example, may be formed by dark resin, metal oxide, etc. The display device 60 may further include other conventional structures and components, which are not described in detail here.

Figure 14:
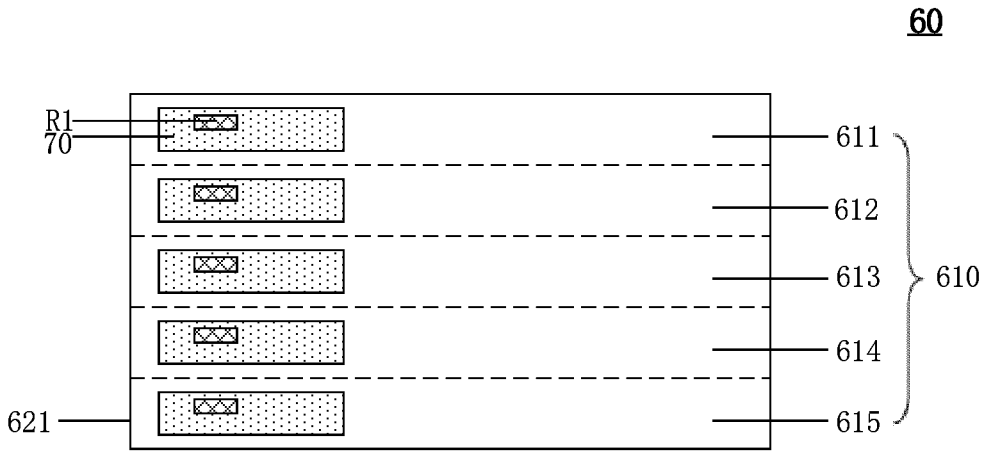
FIG. 14 is a schematic plane diagram of a display device provided by some embodiments of the present disclosure.

FIG. 14 is a schematic plane diagram of a display device provided by some embodiments of the present disclosure. For example, in an example, as illustrated in FIG. 14, the backlight 610 of the display device 60 adopts the local dimming mode (a dimming mode using a time-domain duty cycle) to adjust the light intensity, and includes a plurality of light-emitting regions 611-615. For example, the plurality of light-emitting regions 611-615 extend in a horizontal direction, for example, parallel to the extending direction of the gate lines (not illustrated in the figure) in the display device 60. For example, the extending direction of the gate lines can be referred to the conventional design, which is not described in detailed here. It should be noted that in some embodiments of the present disclosure, the number of the light-emitting regions is not limited. Although five light-emitting regions are illustrated in FIG. 14, this does not constitute a limitation on the embodiments of the present disclosure, and the number of the light-emitting regions may be determined according to actual needs, for example, according to the characteristics of the backlight 610.

For example, the gate driving circuit includes a plurality of shift register units 70 that are cascaded, and the shift register unit 70 may be the aforementioned shift register unit 10/20/30/40. The plurality of shift register units 70 are in one-to-one correspondence with the plurality of light-emitting regions 611-615, and a projection of the variable resistor 210 (e.g., the photoresistor R1), which is in respective shift register unit 70, in a direction perpendicular to the base substrate 621 is within a corresponding light-emitting region. It should be noted that, the blocks representing the shift register unit 70 and the photoresistor R1 in FIG. 14 do not indicate the actual shape of the shift register unit 70 and the photoresistor R1, but indicate projection positions of the shift register unit 70 and the photoresistor R1 in the direction perpendicular to the base substrate 621. In addition, the above blocks only represent the relative positions of the projections and the plurality of light-emitting regions 611-615, and do not represent the specific shape of the projections. It should be noted that, in some other embodiments of the present disclosure, according to the size of the light-emitting region of the backlight 610, a plurality of shift register units 70 (e.g., 2, 3, 4, etc.) may correspond to one light-emitting region, which is not limited in the embodiments of the present disclosure.

When the backlight 610 adjusts the light intensity, the brightness of different light-emitting regions of the backlight 610 are not uniform at the same time before the entire backlight reaches the highest brightness, and the photoresistor R1 corresponding to a light-emitting region senses the light intensity of the corresponding light-emitting region to adjust the level of the scanning signal output by the corresponding shift register unit 70 based on the resistance change of the photoresistor R1, thereby adjusting the charging rate of the corresponding pixel unit receiving the scanning signal in the display device 60, so that the charging effects of the pixel unit are the same or similar when the light intensity is different, which reduces or eliminates the horizontal stripes caused by the RC delay due to different light intensity.

At least one embodiment of the present disclosure further provides a method of driving a shift register unit, which can be used to drive the shift register unit 10/20/30/40 provided by any one of the embodiments of the present disclosure. By using this method, the level of the scanning signal in the bright state of illumination is higher than the level in the dark state, thereby adjusting the charging rate of the pixel unit, so that the charging effects of the pixel unit are the same or similar when the light intensity is different, which reduces or eliminates the horizontal stripes caused by the RC delay due to different light intensity.

For example, in an example, the method of driving the shift register unit 10/20/30/40 includes following operations.

In an input phase (that is, the aforementioned first phase 1), the input circuit 100 writes the input signal to the first node PU in response to the input control signal and controls the level of the first node PU to a first level, and the output circuit 200 outputs the scanning signal with a second level through the pixel signal output terminal OP1.

In an output phase (that is, the aforementioned second phase 2), the output circuit 200 outputs the scanning signal with a third level through the pixel signal output terminal OP1.

For example, the third level varies according to the resistance value of the variable resistor 210. For example, the first level is a high level, the second level is a low level, and the third level is a high level and may be the same as or different from the first level.

For example, in the output phase, in the case where the light intensity received by the variable resistor 210 increases, the resistance value of the variable resistor 210 decreases to adjust the third level, so as to allow the third level to increase; and in the case where the light intensity decreases, the resistance value of the variable resistor 210 increases to adjust the third level, so as to allow the third level to decrease.

It should be noted that, for a detailed description and technical effect of the method, reference may be made to the corresponding description of the shift register unit 10/20/30/40 in the embodiments of the present disclosure, and details are not described here.

The following statements should be noted.

(1) The accompanying drawings involve only the structure(s) in connection with the embodiment(s) of the present disclosure, and other structure(s) can be referred to common design(s).

(2) In case of no conflict, features in one embodiment or in different embodiments can be combined to obtain new embodiments.

What have been described above are only specific implementations of the present disclosure, the protection scope of the present disclosure is not limited thereto, and the protection scope of the present disclosure should be based on the protection scope of the claims.

What is claimed is:

1. A shift register unit, comprising an input circuit and an output circuit, wherein the input circuit is connected to an input terminal and a first node, and is configured to write an input signal of the input terminal to the first node in response to an input control signal to control a level of the first node; and the output circuit is connected to the first node, a clock signal terminal, and a pixel signal output terminal, and is configured to receive a clock signal of the clock signal terminal and output a scanning signal through the pixel signal output terminal under control of the level of the first node, the output circuit comprises a variable resistor, and the variable resistor is configured to adjust a level of the scanning signal according to a resistance value of the variable resistor.

2. The shift register unit according to claim 1, wherein the variable resistor comprises a photoresistor, the photoresistor comprises a photoelectric sensitive material, and a resistance value of the photoelectric sensitive material is in a negative correlation with light intensity that is received.

3. The shift register unit according to claim 2, wherein the output circuit is further connected to a shift signal output terminal, and the output circuit further comprises a first transistor, a second transistor, and a first capacitor;

a gate electrode of the first transistor is connected to the first node, a first electrode of the first transistor is connected to the clock signal terminal, and a second electrode of the first transistor is connected to the shift signal output terminal;

a gate electrode of the second transistor is connected to the first node, a first electrode of the second transistor is connected to the clock signal terminal, and a second electrode of the second transistor is connected to a first terminal of the variable resistor;

a first electrode of the first capacitor is connected to the first node, and a second electrode of the first capacitor is connected to the pixel signal output terminal; and a second terminal of the variable resistor is connected to the pixel signal output terminal.

4. A gate driving circuit, comprising the shift register unit according to claim 2.

5. The shift register unit according to claim 1, wherein the variable resistor comprises a thermistor having a negative temperature coefficient.

6. The shift register unit according to claim 5, wherein the output circuit is further connected to a shift signal output terminal, and the output circuit further comprises a first transistor, a second transistor, and a first capacitor;

a gate electrode of the first transistor is connected to the first node, a first electrode of the first transistor is connected to the clock signal terminal, and a second electrode of the first transistor is connected to the shift signal output terminal;

a gate electrode of the second transistor is connected to the first node, a first electrode of the second transistor is connected to the clock signal terminal, and a second electrode of the second transistor is connected to a first terminal of the variable resistor;

a first electrode of the first capacitor is connected to the first node, and a second electrode of the first capacitor is connected to the pixel signal output terminal; and a second terminal of the variable resistor is connected to the pixel signal output terminal.

7. A gate driving circuit, comprising the shift register unit according to claim 5.

8. The shift register unit according to claim 1, wherein the output circuit is further connected to a shift signal output terminal, and the output circuit further comprises a first transistor, a second transistor, and a first capacitor;

a gate electrode of the first transistor is connected to the first node, a first electrode of the first transistor is connected to the clock signal terminal, and a second electrode of the first transistor is connected to the shift signal output terminal;

a gate electrode of the second transistor is connected to the first node, a first electrode of the second transistor is connected to the clock signal terminal, and a second electrode of the second transistor is connected to a first terminal of the variable resistor;

a first electrode of the first capacitor is connected to the first node, and a second electrode of the first capacitor is connected to the pixel signal output terminal; and a second terminal of the variable resistor is connected to the pixel signal output terminal.

9. The shift register unit according to claim 8, further comprising a first control circuit, a second control circuit, a first node noise reduction circuit, an output noise reduction circuit, a first reset circuit, and a second reset circuit, wherein the first control circuit is configured to control a level of a second node under control of the level of the first node and a level of a first control node;

the second control circuit is configured to control the level of the first control node under control of the level of the first node;

the first node noise reduction circuit is configured to perform noise reduction on the first node under control of the level of the second node;

the output noise reduction circuit is configured to perform noise reduction on the shift signal output terminal and the pixel signal output terminal under control of the level of the second node;

the first reset circuit is configured to reset the first node in response to a first reset signal; and the second reset circuit is configured to reset the first node in response to a second reset signal.

10. The shift register unit according to claim 9, wherein the first control circuit comprises a fourth transistor and a fifth transistor;

a gate electrode of the fourth transistor is connected to the first control node, a first electrode of the fourth transistor is connected to a first voltage terminal, and a second electrode of the fourth transistor is connected to the second node; and a gate electrode of the fifth transistor is connected to the first node, a first electrode of the fifth transistor is connected to the second node, and a second electrode of the fifth transistor is connected to a second voltage terminal.

11. The shift register unit according to claim 9, wherein the second control circuit comprises a sixth transistor and a seventh transistor;

a gate electrode of the sixth transistor is connected to a first electrode of the sixth transistor, and is connected to a first voltage terminal, and a second electrode of the sixth transistor is connected to the first control node; and a gate electrode of the seventh transistor is connected to the first node, a first electrode of the seventh transistor is connected to the first control node, and a second electrode of the seventh transistor is connected to a second voltage terminal.

12. The shift register unit according to claim 9, wherein the first node noise reduction circuit comprises an eighth transistor; and a gate electrode of the eighth transistor is connected to the second node, a first electrode of the eighth transistor is connected to the first node, and a second electrode of the eighth transistor is connected to a second voltage terminal.

13. The shift register unit according to claim 9, wherein the output noise reduction circuit comprises a ninth transistor and a tenth transistor;

a gate electrode of the ninth transistor is connected to the second node, a first electrode of the ninth transistor is connected to the shift signal output terminal, and a second electrode of the ninth transistor is connected to a second voltage terminal; and a gate electrode of the tenth transistor is connected to the second node, a first electrode of the tenth transistor is connected to the pixel signal output terminal, and a second electrode of the tenth transistor is connected to a third voltage terminal.

14. The shift register unit according to claim 9, wherein the first reset circuit comprises an eleventh transistor, a gate electrode of the eleventh transistor is connected to a first reset terminal, a first electrode of the eleventh transistor is connected to the first node, and a second electrode of the eleventh transistor is connected to a second voltage terminal; and the second reset circuit comprises a twelfth transistor, a gate electrode of the twelfth transistor is connected to a second reset terminal, a first electrode of the twelfth transistor is connected to the first node, and a second electrode of the twelfth transistor is connected to the second voltage terminal.

15. A gate driving circuit, comprising the shift register unit according to claim 8.

16. The shift register unit according to claim 1, wherein the input circuit comprises a third transistor; and a gate electrode of the third transistor is connected to a first electrode of the third transistor, and is connected to the input terminal, the gate electrode of the third transistor receives the input signal as the input control signal, and a second electrode of the third transistor is connected to the first node.

17. A gate driving circuit, comprising the shift register unit according to claim 1.

18. A display device, comprising the gate driving circuit according to claim 17, and further comprising a backlight and an array substrate, wherein the array substrate comprises a base substrate, a light blocking layer, and a gate driving circuit layer, the light blocking layer is on the base substrate, the gate driving circuit layer is on a side, away from the base substrate, of the light blocking layer, and the gate driving circuit is provided in the gate driving circuit layer; and the gate driving circuit layer comprises the variable resistor, and the light blocking layer has an opening at a position corresponding to the variable resistor, so that light emitted by the backlight can be irradiated to the variable resistor through the opening.

19. The display device according to claim 18, wherein the gate driving circuit comprises a plurality of shift register units that are cascaded, and the backlight comprises a plurality of light-emitting regions; and the plurality of shift register units are in one-to-one correspondence with the plurality of light-emitting regions, and a projection of the variable resistor, which is in respective shift register unit, in a direction perpendicular to the base substrate is within a corresponding light-emitting region.

20. A method of driving the shift register unit according to claim 1, comprising:

in an input phase, by the input circuit, writing the input signal to the first node in response to the input control signal and controlling the level of the first node to a first level, and by the output circuit, outputting the scanning signal with a second level through the pixel signal output terminal; and in an output phase, by the output circuit, outputting the scanning signal with a third level through the pixel signal output terminal, wherein the third level varies according to the resistance value of the variable resistor, in the output phase, in a case where light intensity received by the variable resistor increases, the resistance value of the variable resistor decreases to adjust the third level, so as to allow the third level to increase, and in a case where the light intensity decreases, the resistance value of the variable resistor increases to adjust the third level, so as to allow the third level to decrease.

* * * * *